US010129652B2

(12) United States Patent
Vieites et al.

(10) Patent No.: US 10,129,652 B2
(45) Date of Patent: Nov. 13, 2018

(54) AUDIO SPEAKER SURROUND GEOMETRY FOR IMPROVED PISTONIC MOTION

(71) Applicant: Apple Inc., Cupertino, CA (US)

(72) Inventors: Pablo Seoane Vieites, Sunnyvale, CA (US); Christopher Wilk, Los Gatos, CA (US); Suzanne Hardy, San Jose, CA (US); Alexander V. Salvatti, Morgan Hill, CA (US); Oliver Leonhardt, San Jose, CA (US); Scott P. Porter, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/726,288

(22) Filed: May 29, 2015

(65) Prior Publication Data

US 2016/0080870 A1 Mar. 17, 2016

Related U.S. Application Data

(60) Provisional application No. 62/049,990, filed on Sep. 12, 2014.

(51) Int. Cl.

| | |
|---|---|
| ***H04R 7/26*** | (2006.01) |
| ***H04R 7/18*** | (2006.01) |
| ***H04R 7/16*** | (2006.01) |

(52) U.S. Cl.

CPC ..... *H04R 7/26* (2013.01); *H04R 7/16* (2013.01); *H04R 7/18* (2013.01); *H04R 2307/207* (2013.01)

(58) Field of Classification Search

CPC ... H04R 7/16; H04R 7/18; H04R 7/20; H04R 9/16; H04R 31/003; H04R 31/006;

(Continued)

(56) References Cited

U.S. PATENT DOCUMENTS 3,130,811 A * 4/1964 Petrie ..... H04R 7/20 181/172

4,324,312 A 4/1982 Durbin et al.

(Continued)

FOREIGN PATENT DOCUMENTS

EP 0 556 786 A1 8/1993
EP 0 556 786 A2 8/1993

(Continued)

OTHER PUBLICATIONS

PCT International Search Report and Written Opinion for PCT International Appln No. PCT/US2015/047254 dated Nov. 3, 2015. (12 pages).

(Continued)

*Primary Examiner* — Fan Tsang

*Assistant Examiner* — Angelica M McKinney

(74) *Attorney, Agent, or Firm* — Womble Bond Dickinson (US) LLP

(57) ABSTRACT

An audio speaker having a suspension system including a surround to support a diaphragm within a frame and to reduce non-pistonic motion of the diaphragm at several resonant frequencies is disclosed. More particularly, embodiments of the surround include a film that undulates in a peripheral direction around the diaphragm and includes several undulations above and below a radial gap between the diaphragm and the frame. Other embodiments are also described and claimed.

21 Claims, 14 Drawing Sheets

(58) Field of Classification Search
CPC ..... H04R 9/043; H04R 2231/003; H04R 2307/201; H04R 2307/204; H04R 2307/207; G10K 13/00
See application file for complete search history.

(56) References Cited

U.S. PATENT DOCUMENTS 4,433,214 A * 2/1984 Jasinski ..... H04R 7/20 181/172
5,455,396 A * 10/1995 Willard ..... H04R 7/20 181/172
6,095,280 A 8/2000 Proni
6,176,345 B1 1/2001 Perkins et al.
6,516,077 B1 2/2003 Yamaguchi et al.
7,233,681 B2 6/2007 Tummire et al.
7,275,620 B1 * 10/2007 Diedrich ..... H04R 7/16 181/171
7,729,504 B2 * 6/2010 Tsuda ..... H04R 9/027 381/396
8,139,812 B2 * 3/2012 Basnet ..... H04R 7/20 181/171
8,170,268 B2 5/2012 Weyreuther
8,170,286 B2 5/2012 Kashimura et al.
8,311,263 B2 11/2012 Huang
8,442,259 B2 5/2013 Williamson
8,903,117 B1 * 12/2014 Dai ..... H04R 7/16 381/386
2002/0170773 A1 * 11/2002 Stead ..... G10K 13/00 181/171
2003/0068064 A1 * 4/2003 Czerwinski ..... H04R 7/20 381/398
2003/0121718 A1 7/2003 Stead et al.
2004/0086143 A1 * 5/2004 Espiritu ..... H04R 7/16 381/398
2006/0251286 A1 11/2006 Stiles
2009/0208048 A1 8/2009 Haas
2011/0164782 A1 * 7/2011 Bogdanov ..... H04R 7/20 381/432
2012/0039494 A1 * 2/2012 Ellis ..... H04R 9/027 381/166
2017/0111729 A1 * 4/2017 Robineau ..... H04R 1/24

FOREIGN PATENT DOCUMENTS

EP 0 556 786 A3 8/1993
EP 0 556 786 B1 7/2002
EP 0 912 072 B1 7/2005
EP 1 788 839 A1 5/2007
GB 2499228 A 8/2013
JP S58-127499 7/1983

OTHER PUBLICATIONS

International Preliminary on Patentability Chapter 1 for PCT International Appln No. PCT/US2015/047254 dated Mar. 3, 2017. (7 pages).

* cited by examiner

DETAIL A

A - A

B - B

DETAIL A

C - C

AUDIO SPEAKER SURROUND GEOMETRY FOR IMPROVED PISTONIC MOTION

This application claims the benefit of U.S. Provisional Patent Application No. 62/049,990, filed Sep. 12, 2014, and this application hereby incorporates herein by reference that provisional patent application.

BACKGROUND

Field

Embodiments related to audio speakers and audio speaker suspension systems are disclosed. More particularly, an embodiment related to an audio speaker surround having a film that undulates in a peripheral direction around a speaker diaphragm, is disclosed.

Background Information

An audio speaker, such as a loudspeaker, converts an electrical audio input signal into an emitted sound. Audio speakers typically include a moving assembly that is connected to a stationary assembly by a suspension system. The moving assembly may include a diaphragm connected with a driving element, e.g., one of either a voicecoil or a magnet, while the stationary assembly may include a frame and a complementary driving element, e.g., the other of the voicecoil or the magnet. The suspension system typically includes elements that keep the moving assembly centered relative to the stationary assembly. For example, a surround may connect the diaphragm with the frame and/or a spider may connect the driving element with the frame. Thus, when the electrical audio input signal is input to the voicecoil, a mechanical force may be generated that moves the moving assembly from a neutral position in an axial direction relative to the frame. This axial motion is referred to as pistonic motion. The moving assembly may also experience a degree of non-axial motion, i.e., non-pistonic motion. In fact, at certain resonant frequencies, the non-pistonic modes of motion, i.e., the "racing modes," may tend to dominate pistonic motion. The non-pistonic motion in these racing modes may cause the voicecoil to stretch and/or rub against the magnet, and over time, this can lead to issues with the emitted sound quality or cause failure of the audio speaker.

SUMMARY

Audio speakers having a suspension system including a surround to support a diaphragm within a frame and to reduce non-pistonic motion of the diaphragm at several resonant frequencies, are disclosed. In an embodiment, an audio speaker includes a frame having an inner rim, a diaphragm having an outer rim separated from the inner rim by a radial gap, and a surround supporting the diaphragm relative to the frame. The audio speaker may be a single-suspension audio speaker, i.e., may include the surround but no spider. The speaker surround may include a film, e.g., an elastic film, which undulates in a peripheral direction along the radial gap around the outer rim. More particularly, the film may include several surround segments with respective surface boundaries surrounding one or more undulations. The respective surface boundaries may be defined by an inner edge of the film attached to the outer rim, an outer edge of the film attached to the inner rim, and respective pairs of radial line segments extending from the inner edge to the outer edge, e.g., across or along the radial gap. The undulation(s) within a respective surface boundary may include an upper undulation disposed above the radial gap and/or a lower undulation disposed below the radial gap. Each undulation may have a respective smooth surface curvature extending across the respective surface boundary. Furthermore, in an example, in addition to portions of the surround having the surround segments, the surround may extend along a corner region of the outer rim, and the undulating film may have no undulations along the corner region. As such, stresses may concentrate in the undulations along the outer rim sides (non-corner regions) to control and limit non-pistonic motion, rather than being concentrated along the corner regions, which could exacerbate non-pistonic motion. Accordingly, the audio speaker may include a driving element coupled with the diaphragm to drive the diaphragm at several resonant frequencies such that the diaphragm and the driving element move within an axial degree of freedom and one or more non-axial degrees of freedom at each resonant frequency, and the undulating film of the surround may maintain participation in the axial degree of freedom to not less than within one order of magnitude of participation in each non-axial degree of freedom at each resonant frequency.

In an embodiment, a speaker surround includes a film with an inner edge separated from an outer edge along a radial plane, and the film may have an undulating film surface that includes several upper undulations above the radial gap and several lower undulations below the radial gap. The upper undulations and lower undulations may have respective surface boundaries and the undulations may also include respective smooth surface curvatures extending across the boundaries. For example, the smooth curvatures may be partly defined by respective peripheral chords intersecting respective radial chords at respective curvature apices. The respective peripheral chords of different undulation curvatures may be contiguous with each other, e.g., a peripheral chord of an upper undulation may be contiguous with a peripheral chord of a lower undulation such that the upper undulation and lower undulation are sequentially arranged in the peripheral direction around the outer rim of the diaphragm. Furthermore, in an embodiment, respective surface boundaries of the sequentially arranged upper and lower undulations may share a radial line segment such that the undulations are contiguous, e.g., immediately adjacent to each other, in the peripheral direction. The shared radial line segment may be a straight line extending across the radial gap, or alternatively, the shared radial line segment may be a curvilinear line extending across the radial gap. Thus, the undulations may be side-by-side in a peripheral direction, but not side-by-side in a radial direction.

In an embodiment, a speaker surround includes a film with an inner edge separated from an outer edge along a radial plane, and the film may have an undulating film surface that includes a repeating surround segment. The repeating surround segment may be repeated in a peripheral direction along the film. The repeating surround segment may include a surface boundary defined by the inner edge and the outer edge of the speaker surround, as well as a respective pair of radial line segments extending from the inner edge to the outer edge. Furthermore, the repeating surround segment may undulate in the peripheral direction along an intermediate line disposed between the inner edge and the outer edge, and thus, the radial line segments may intersect the intermediate line. The repeating surround segment may include one or more of an upper undulation above the radial gap or a lower undulation below the radial gap, and the upper undulation and lower undulation, if present, may have respective smooth surface curvatures extending across the surface boundary. For example, in an embodiment, the repeating surround segment includes both an upper undulation and a lower undulation. In such a case, the upper undulation and the lower undulation may be radially separated by the intermediate line, e.g., the upper undulation and the lower undulation may have respective smooth surface curvatures that intersect at the intermediate line. As such, the upper undulation may include a respective peripheral chord on an opposite side of the intermediate line relative to a respective peripheral chord of the lower undulation. Thus, an upper apex of the upper undulation may not be aligned along a same peripheral chord with a lower apex of the lower undulation, i.e., the apices may be radially offset. The upper undulation and the lower undulation may nonetheless provide a contiguous surface curvature extending across the surface boundary of the repeating surround segment, i.e., the repeating surround segment may include a continuous smooth surface having portions above and below the radial gap. Thus, the undulations may be side-by-side in a peripheral direction and/or side-by-side in a radial direction.

In an embodiment, several repeating surround segments having surface contours with portions above and below a radial plane may be arranged sequentially in the peripheral direction, and may share radial line segments such that the repeating surround segments are contiguous in the peripheral direction. The shared radial line segments of immediately adjacent surround segments may be curvilinear, rather than straight. For example, a shared radial line segment may be a sinusoidal line segment that intersects an intermediate line on the radial plane at a point between an inner edge and an outer edge of the contour. The intersection point of the intermediate line and the radial line segment may be at an inflection point of the radial line segment coinciding with a location where an upper undulation transitions into a lower undulation.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
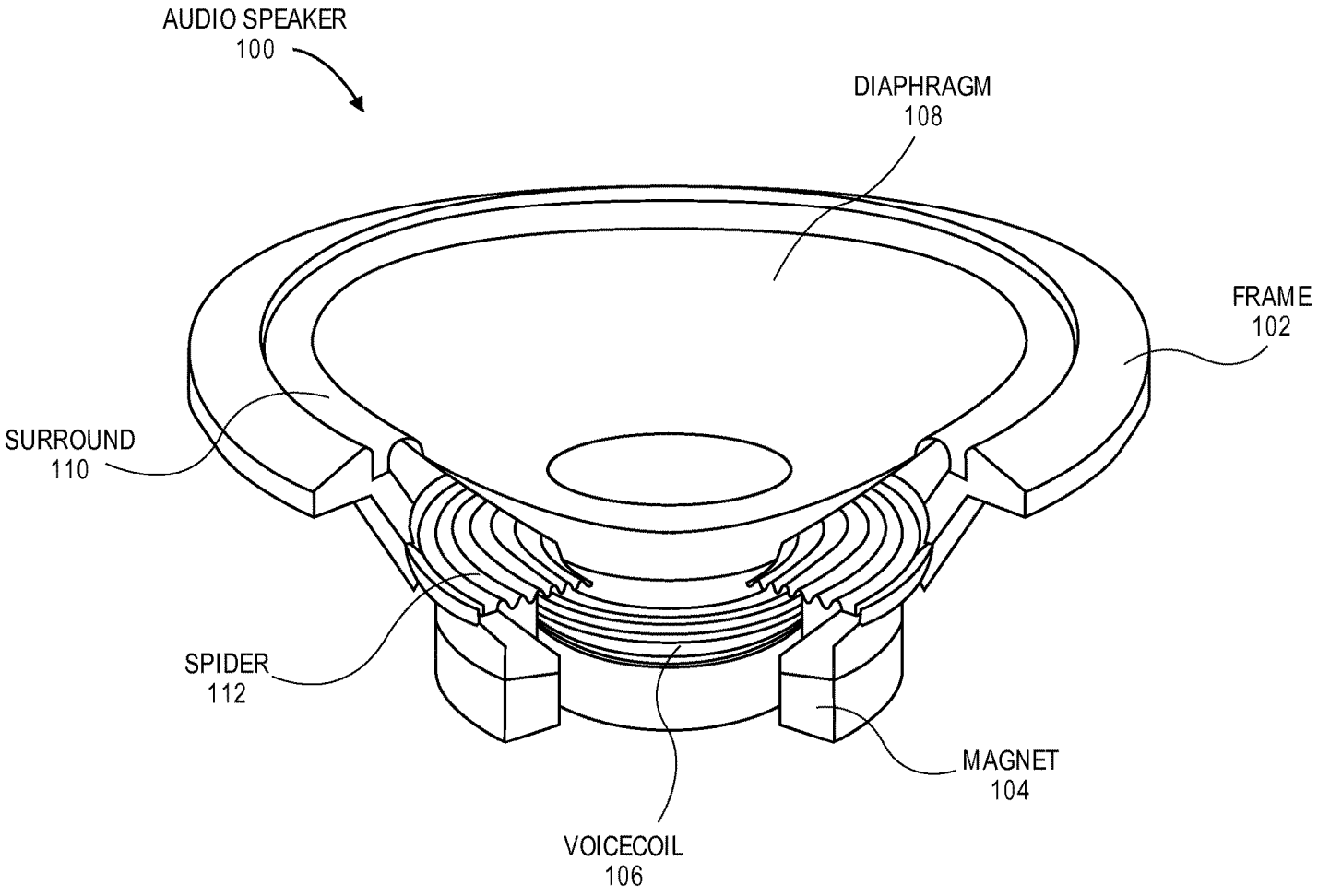
FIG. 1 is a perspective cutaway view of an audio speaker in accordance with an embodiment.

Embodiments describe suspension systems having an undulating film to reduce non-pistonic motion of an oscillating mass at several resonant frequencies, particularly for use in audio speaker applications. While some embodiments are described with specific regard to integration within single-suspension audio speakers, the embodiments are not so limited and certain embodiments may also be applicable to audio speakers having two or more suspenders. Furthermore, a surround as described below may be applicable to other uses, e.g., non-acoustic applications having a moving assembly driven at various resonant frequencies for which non-pistonic motion is undesirable.

In various embodiments, description is made with reference to the figures. Certain embodiments, however, may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description, such as "above" and "below" may denote a relative position or direction. For example, an undulation may be described as being "above" a radial gap to indicate that the undulation may be located on one side of a geometric plane extending through the radial gap, while an undulation may be described as being "below" the radial gap to indicate that the undulation may be located on the other side of the geometric plane. Nonetheless, such terms are not intended to limit the use of an audio speaker to a specific configuration described in the various embodiments below. For example, an audio speaker having a surround with an undulation "above" a certain location may nonetheless be directed in any direction with respect to an external environment, including such that the undulation is directed toward the ground.

In an aspect, a speaker surround includes a film that undulates around a perimeter of a speaker diaphragm such that a combination of upper undulations above a radial gap and lower undulations below the radial gap support the diaphragm within a speaker frame. For example, a sequence of repeating upper undulations spaced apart by repeating lower undulations may support the diaphragm within the speaker frame. Thus, loads applied by the moving diaphragm may be distributed within the undulations in a complementary manner, i.e., upper undulations may be placed in tension while lower undulations are placed in compression, and vice versa. Such complementary stress distribution can control and/or limit non-pistonic motion, e.g., racing modes, of a moving assembly of the audio speaker at certain resonant frequencies. For example, participation of the moving assembly in the non-pistonic modes may be reduced as compared to participation by the moving assembly in those modes when supported by a traditional half-arc, non-undulating speaker surround. Therefore, an undulating surround film as described below may prevent rub and buzz, sound distortion, and speaker failure issues that can arise with traditional speaker surrounds.

In an aspect, an undulating speaker surround provides a low-cost solution to the racing mode issues described above. Since racing modes typically occur at only a few resonant frequencies within the range of frequencies used during sound reproduction, the frequency response of an audio speaker may be electronically adjusted around those frequencies to mitigate rub and buzz issues. Such electronic compensation, however, may be relatively complex and costly to implement in a media player used to control the audio speaker. Furthermore, since the racing mode frequencies may change based on thermal considerations and speaker aging, electronic compensation may be ineffective as temperatures change or the audio speaker is used over time. By contrast, an undulating speaker surround as described below may be manufactured using low-cost manufacturing techniques, such as thermoforming, and once fabricated, may limit rocking of the diaphragm within racing modes at any resonant frequency, regardless of whether the resonant frequency shifts due to time or temperature changes.

Referring to FIG. 1, a perspective cutaway view of an audio speaker is shown in accordance with an embodiment. An audio speaker 100, such as a micro speaker or loudspeaker, may include a frame 102, such as a stationary and/or rigid chassis or basket. Frame 102 may be connected to a stationary portion of a motor assembly, such as magnet 104. Thus, the rigidity of frame 102 may maintain the stationary portion in a fixed location, to avoid deformation or movement that can cause rubbing with a moving portion of the motor assembly. Magnet 104 may have an annular shape with a central opening to receive and surround the moving portion of the motor assembly. More particularly, a voicecoil 106 may be suspended within the annulus of magnet 104 and be movable relative to magnet 104 within a magnetic gap between the magnet 104 and voicecoil 106. When an electrical audio signal is input to voicecoil 106, e.g., from a media player or other audio equipment, a magnetic field may be created by an electric current in a wire winding, e.g., copper, aluminum, or silver wire, of the voicecoil 106. The magnetic field may interact with magnet 104 across the magnetic gap to generate a mechanical force that moves the voicecoil 106 back and forth. More particularly, voicecoil 106 may be connected to a lower region of a diaphragm 108, and thus, the electrical audio signal may generate a mechanical force that moves the diaphragm 108 back and forth along an axis that passes through the center of voicecoil 106 and/or magnet 104. This rapid pistonic movement can create pressure waves that are heard as sounds. To maximize magnetic energy in the magnetic gap, the voicecoil 106 and magnet 104 may be located as close to one another as possible, without touching. More particularly, contact between voicecoil 106 and magnet 104 may be avoided during sound reproduction to avoid speaker failure and/or sound distortion. Accordingly, maximizing pistonic motion and minimizing non-pistonic motion of voicecoil 106 and/or magnet 104 across the range of drive frequencies may be desirable in audio speaker 100.

Diaphragm 108 may have a concave upper profile, such as a cone or dome, and be formed from a rigid, low-mass material, e.g., plastic or metal. Diaphragm 108 may be concentrically supported within frame 102 with a gap between an outer rim of diaphragm 108 and an inner rim of frame 102. The outer rim of diaphragm 108 may be any of several shapes, including circular, as shown in FIG. 1, or rectangular, as is described below and may be commonly found in micro speakers. In an embodiment, the outer rim of diaphragm 108 and the inner rim of frame 102 may include conforming shapes, e.g., both may be circular or both may be rectangular. In other embodiments, the profiles may differ, e.g., a circular diaphragm rim may be coaxially arranged with a rectangular frame rim. Thus, audio speaker 100 may have a moving assembly that includes diaphragm 108 connected with voicecoil 106, and a stationary assembly that includes frame 102 connected with magnet 104. Furthermore, the moving assembly may be concentrically supported and/or suspended relative to the stationary assembly by a suspension system that facilitates pistonic movement of the moving assembly.

In an embodiment, the suspension system centers voicecoil 106 within the magnetic annulus of magnet 104 and may also provide a restoring force that biases diaphragm 108 toward a neutral position in a direction opposite to the mechanical force that moves the diaphragm 108 back and forth. The suspension system may be a single-suspension system or a double-suspension system. For example, in an embodiment, the suspension system is a single-suspension system having a surround 110 to support diaphragm 108 within frame 102 without the aid of a spider 112. Alternatively, the suspension system may be a double-suspension system having spider 112, in addition to surround 110, to support voicecoil 106 relative to frame 102 and/or magnet 104, as shown in FIG. 1.

Figure 2:
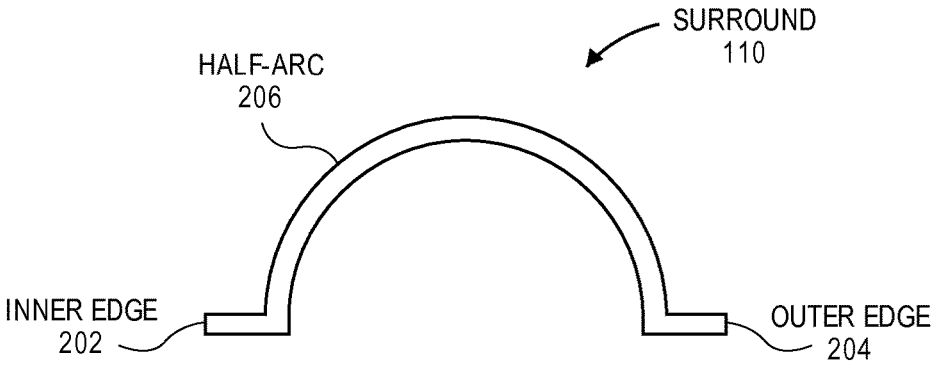
FIG. 2 is a cross-sectional view of a surround in accordance with an embodiment.

Referring to FIG. 2, a cross-sectional view of a surround is shown in accordance with an embodiment. Surround 110 may include an inner edge 202 that may be connected and/or attached to an outer rim of diaphragm 108, as well as an outer edge 204 that may be connected and/or attached to an inner rim of frame 102. For example, the respective edges of surround 110 may be bonded to a respective bonding site using, e.g., chemical adhesives such as glues, thermal welding, or mechanical fasteners. In an embodiment, surround 110 includes a thin membrane or film extending between inner edge 202 and outer edge 204. The film may be shaped to facilitate relative movement between inner edge 202 and outer edge 204. For example, in an embodiment, at least some portion of the film may have a half-arc 206. That is, surround 110 may include a cross-sectional profile having a curvilinear shape extending between inner edge 202 and outer edge 204 in an arched manner. The arc may be above a plane extending through inner edge 202 and outer edge 204, the plane being normal to a direction of pistonic motion of diaphragm 108. Furthermore, the arc may be uniform in a peripheral direction around diaphragm 108, i.e., may have no undulations in the peripheral direction. Accordingly, the half-arc 206 of surround 110 may allow free pistonic motion of diaphragm 108.

Figure 3:
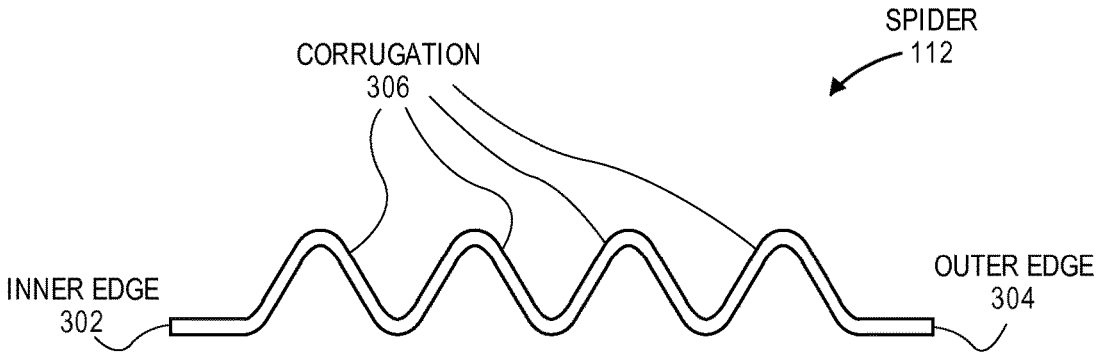
FIG. 3 is a cross-sectional view of a spider in accordance with an embodiment.

Referring to FIG. 3, a cross-sectional view of a spider is shown in accordance with an embodiment. Spider 112 may include inner edge 302 and outer edge 304, which may be bonded to respective bonding sites on, e.g., voicecoil 106 or diaphragm 108 at inner edge 302 and frame 102 or magnet 104 at outer edge 304. In an embodiment, spider 112 includes a thin membrane or film extending between inner edge 302 and outer edge 304. For example, in an embodiment, at least some portion of the film may have one or more corrugations 306. That is, spider 112 may include a cross-sectional profile having several wrinkles or folds alternating between peaks and valleys from inner edge 302 to outer edge 304. The wrinkles may be above a plane extending through inner edge 302 and outer edge 304, the plane being normal to a direction of pistonic motion of diaphragm 108. Furthermore, the wrinkles may be uniform in a peripheral direction, i.e., may have no undulations in the peripheral direction. The corrugations 306 of spider 112 may provide a restoring force to return diaphragm 108 to the neutral position in the axial direction.

Any suspension element of the suspension system may include portions having half-arc 206 or corrugation 306 profiles. For example, surround 110 may support a perimeter of diaphragm 108, and thus, some portions of surround 110 in the peripheral direction, i.e., along the perimeter, may incorporate a half-arc profile 206 while other portions of surround 110 in the peripheral direction may incorporate a corrugated profile 306. Accordingly, surround 110 or spider 112 may incorporate a combination of segments having different film structures that respond differently to various modes of motion of the moving assembly of audio speaker 100.

Figure 4:
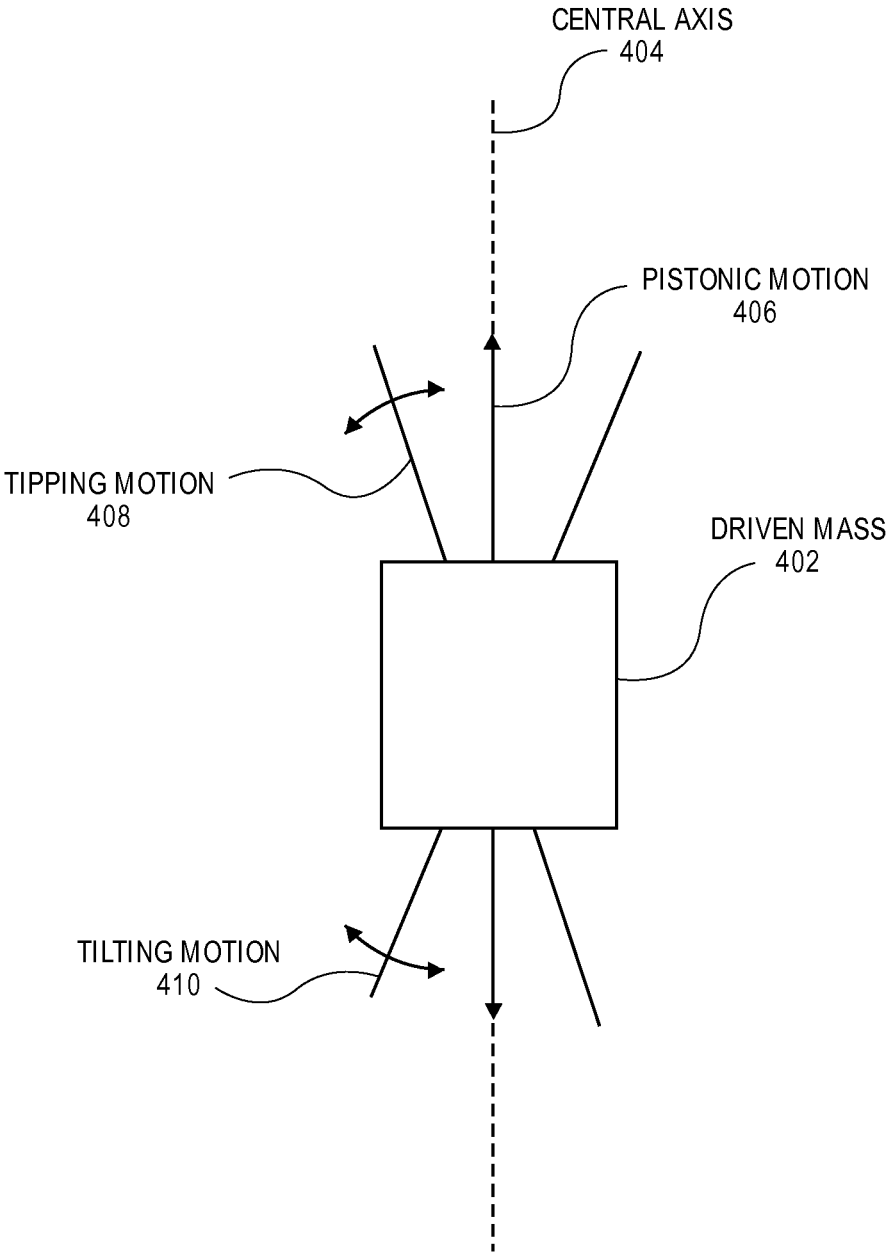
FIG. 4 is a schematic view depicting various modes of motion of an audio speaker in accordance with an embodiment.

Referring to FIG. 4, a schematic view depicting various modes of motion of an audio speaker is shown in accordance with an embodiment. Audio speaker 100 may include a driven mass 402, which may be the total mass of diaphragm 108, voicecoil 106, and any other portion of the moving assembly of audio speaker 100. For example, moving assembly may include a bobbin that voicecoil 106 windings are wound around, a mechanical coupling or fastener that connects voicecoil 106 with diaphragm 108, or other moving parts that contribute to driven mass 402. When acted upon by the mechanical force generated by magnet 104 and voicecoil 106, the driven mass 402 may oscillate along a central axis 404 within an axial degree of freedom, i.e., with pistonic motion 406. Driven mass 402, however, may also participate within other degrees of freedom, e.g., may move in non-pistonic modes, such as rocking about central axis 404 with a tipping motion 408 about an axis orthogonal to central axis 404, or rocking about central axis 404 with a tilting motion 410 about another axis orthogonal to central axis 404. Participation in any of these pistonic and non-pistonic modes may be influenced by the suspension system response at various resonant frequencies. For example, portions of surround 110 having half-arc 206 profile may suspend driven mass 402 such that, at a first eigenfrequency, driven mass 402 may have a participation factor in the pistonic motion 406 mode that is at least four orders of magnitude higher than a participation factor in either of the tipping motion 408 or tilting motion 410 non-pistonic modes. The half-arc 206 profile sections, however, may have a tendency to dissipate vibration energy with out-of-plane motions at higher eigenfrequencies. For example, in the case of a single-suspension system with surround 110 having half-arc 206 profile around the entire perimeter of diaphragm 108, at subsequent eigenfrequencies, non-pistonic motion may dominate, with the participation factor in the pistonic mode being at least two orders of magnitude lower than the participation factors in the non-pistonic modes. Thus, rubbing between voicecoil 106 and magnet 104 may become an issue at these higher eigenfrequencies. Accordingly, it may be advantageous to reduce the tendency of driven mass 402 toward non-pistonic motion at these frequencies, or across the entire driving frequency range.

Figure 5:
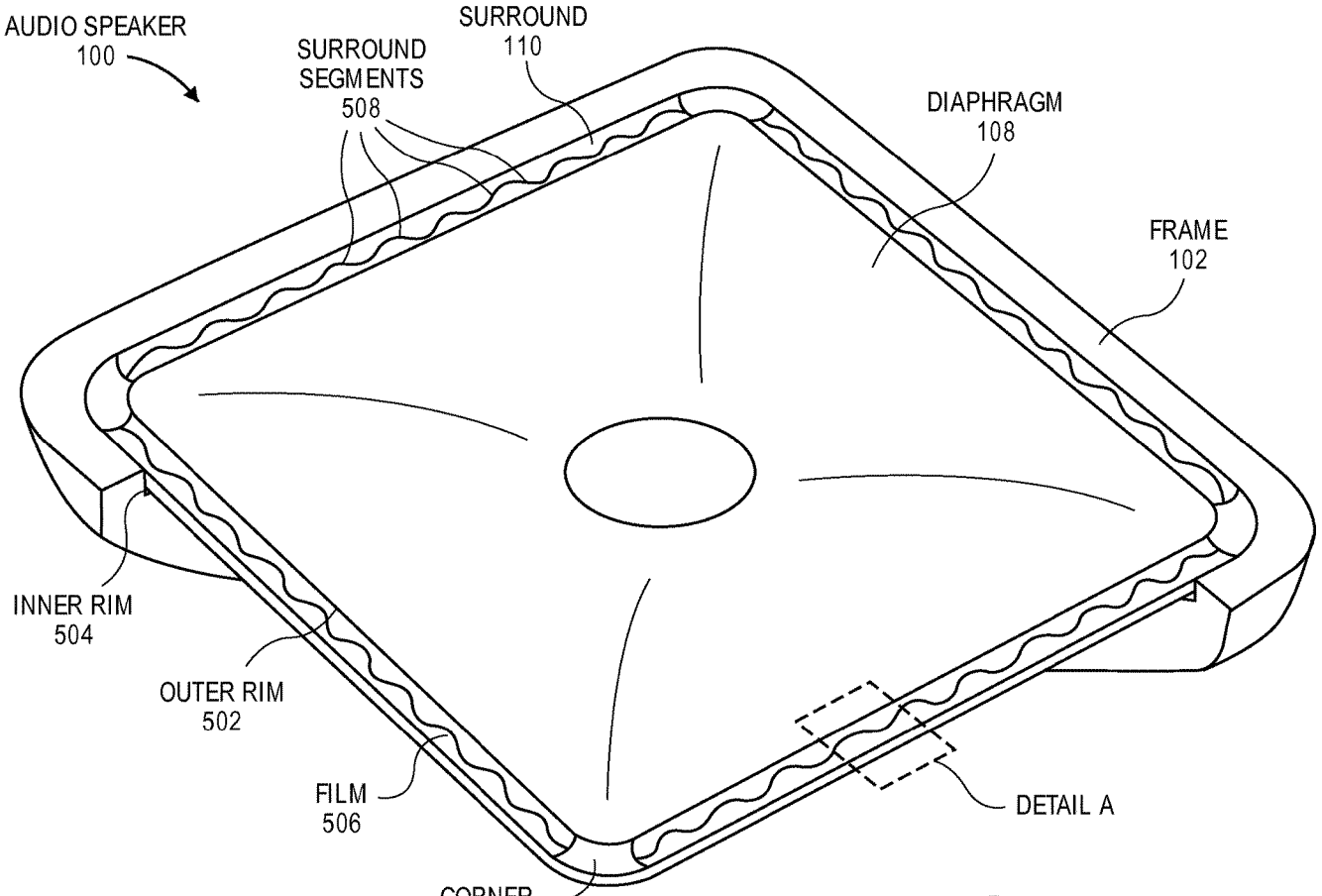
FIG. 5 is a perspective cutaway view of an audio speaker in accordance with an embodiment.

Referring to FIG. 5, a perspective cutaway view of an audio speaker is shown in accordance with an embodiment. In an embodiment, audio speaker 100 includes a suspension system, e.g., a single-suspension system, having surround 110 connecting diaphragm 108 with frame 102. As described above, diaphragm 108 may include a rigid member having circular, rectangular, or any other shaped outer rim 502. Furthermore, frame 102 may include an inner rim 504 shaped similar to outer rim 502. Inner rim 504 and outer rim 502 may be radially separated. Thus, surround 110 may be connected to both outer rim 502 and inner rim 504 to provide a suspension between diaphragm 108 and frame 102. Accordingly, surround 110 may be an essentially circular, rectangular, or other ring-shaped structure filling a gap between outer rim 502 and inner rim 504.

As described above, surround 110 may have a film 506 including a thin flexible sheet formed between outer rim 502 and inner rim 504. For example, film 506 may extend between inner edge 202 and outer edge 204 across the gap between diaphragm 108 and frame 102 and have a cross-sectional profile of half-arc 206 or corrugated profile 306. The half-arc or corrugated profile, as well as any other cross-sectional profile, may be uniform in a peripheral direction over a portion of surround 110. For example, as shown in FIG. 1, surround 110 may have a half-arc 206 cross-sectional profile that is uniform along an entire perimeter of diaphragm 108, e.g., in a circumferential direction around a circular diaphragm 108. Alternatively, as shown in FIG. 5, only a portion of surround 110, e.g., a corner 507 section of a rectangular surround, may include a uniform cross-sectional profile in the peripheral direction. Thus, all or part of film 506 may have a uniform and non-undulating cross-sectional profile in the peripheral direction.

In an embodiment, at least a portion of surround 110 does not have a uniform cross-sectional profile in the peripheral direction. Film 506 may undulate in the peripheral direction such that cross-sections of film 506 taken immediately adjacent to one another are not identical. Accordingly, film 506 may include several undulating surround segments 508 that are periodically and/or sequentially arranged in the peripheral direction around at least a portion of outer rim 502.

Film 506 portions, including those with uniform cross-sectional profiles and non-uniform cross-sectional profiles in the peripheral direction, may be thin and flexible. For example, film 506 may be formed from a thin elastic material, such as soft rubber or another elastomeric material. Film 506 may be single-layered or multi-layered, e.g., film 506 may include laminated layers of one or more flexible materials. Furthermore, film 506 may be fabricated from such materials using a variety of manufacturing techniques. In an embodiment, surround 110 and/or film 506 are thermoformed using thermoplastic polyurethane. Given that film 506 may be formed from a thin elastic material, in an embodiment, surround 110 may provide minimal resistance to movement of diaphragm 108 in the axial direction.

Figure 6:
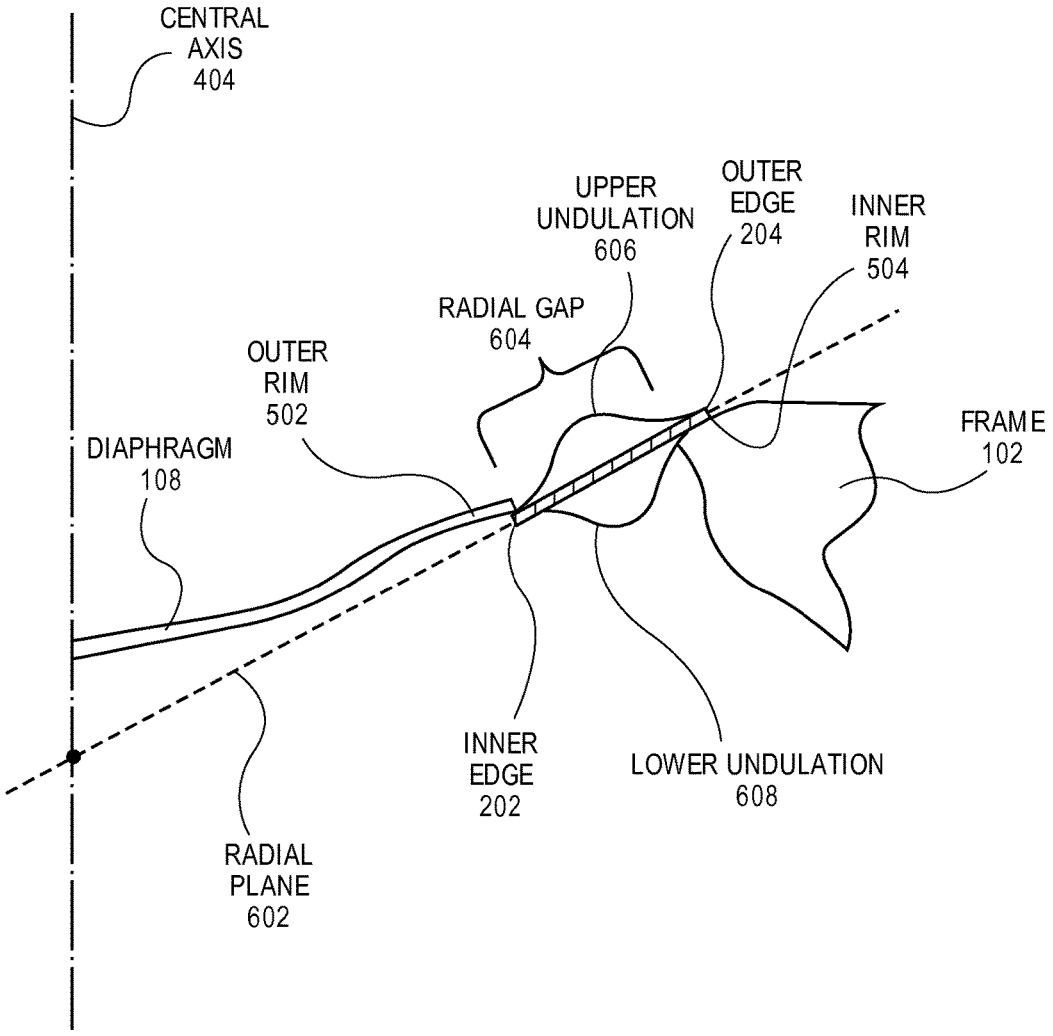
FIG. 6 is a cross-sectional view of a portion of an audio speaker having a surround connecting a diaphragm with a frame in accordance with an embodiment.

Referring to FIG. 6, a cross-sectional view of a portion of an audio speaker having a surround connecting a diaphragm with a frame is shown in accordance with an embodiment. Diaphragm 108 may be symmetric about central axis 404 such that the concave surface extends from central axis 404 to outer rim 502 in all radial directions. The term "radial direction" is used here to describe a direction radiating from central axis 404 toward outer rim 502 of diaphragm 108 and/or inner rim 504 of frame 102. Thus, a radial direction may apply equally to circular and non-circular, e.g., rectangular, diaphragm 108 configurations. Furthermore, the radial direction may, but need not, be along an axis orthogonal to central axis 404. For example, a radial plane 602 may intersect central axis 404 and pass in a radial direction along an angled axis passing through outer rim 502 and inner rim 504, even when outer rim 502 and inner rim 504 are not at the same longitudinal position, or height, along central axis 404. As such, film 506 of surround 110 may have a cross-sectional profile that extends between inner edge 202, which may be connected to outer rim 502, and outer edge 204, which may be connected to inner rim 504, in the radial direction. More particularly, film 506 may extend across a radial gap 604 between outer rim 502 and inner rim 504, and radial gap 604 may have a distance along radial plane 602 in the radial direction. Accordingly, film 506 may provide a hermetic barrier between a space above radial plane 602 and a space below radial plane 602 across radial gap 604. The hermetic barrier may be provided by hermetically sealing inner edge 202 to outer rim 502 and outer edge 204 to inner rim 504 using adhesive or welding, as is known in the art.

As described above, surround 110 may include several surround segments 508, and in an embodiment, these surround segments 508 may be further described as including one or more upper undulation 606 and/or one or more lower undulation 608. Upper undulations 606 may be formed in film 506 above radial gap 604, e.g., on a front side of radial plane 602 along which radial gap 604 lies between outer rim 502 and inner rim 504. Similarly, lower undulations 608 may be formed in film 506 below radial gap 604, e.g., on a rear side of radial plane 602. Thus, regardless of a location in the peripheral direction (into the page through radial gap 604 in FIG. 6) at which a cross-sectional view is taken, upper undulation 606 and lower undulation 608 may have cross-sectional profiles that extend between inner edge 202 and outer edge 204 on a respective side of radial gap 604. In an embodiment, surround segments 508 of surround 110 may be formed on opposite sides of radial gap 604, may be separated in the peripheral direction, and may meet at an intermediate location that extends radially between outer rim 502 and inner rim 504. For example, as shown in FIG. 6, at least one cross-sectional profile of film 506 may be aligned radially along radial plane 602 across radial gap 604. That is, as described below, film 506 may have a cross-section at one or more locations that includes a radially disposed film segment, e.g., a straight line segment within a thickness, across radial gap 604. This straight line segment may lie between and/or be a merger point between a surround segment 508 having upper undulation 606 and another surround segment 508 having lower undulation 608.

Figure 7:
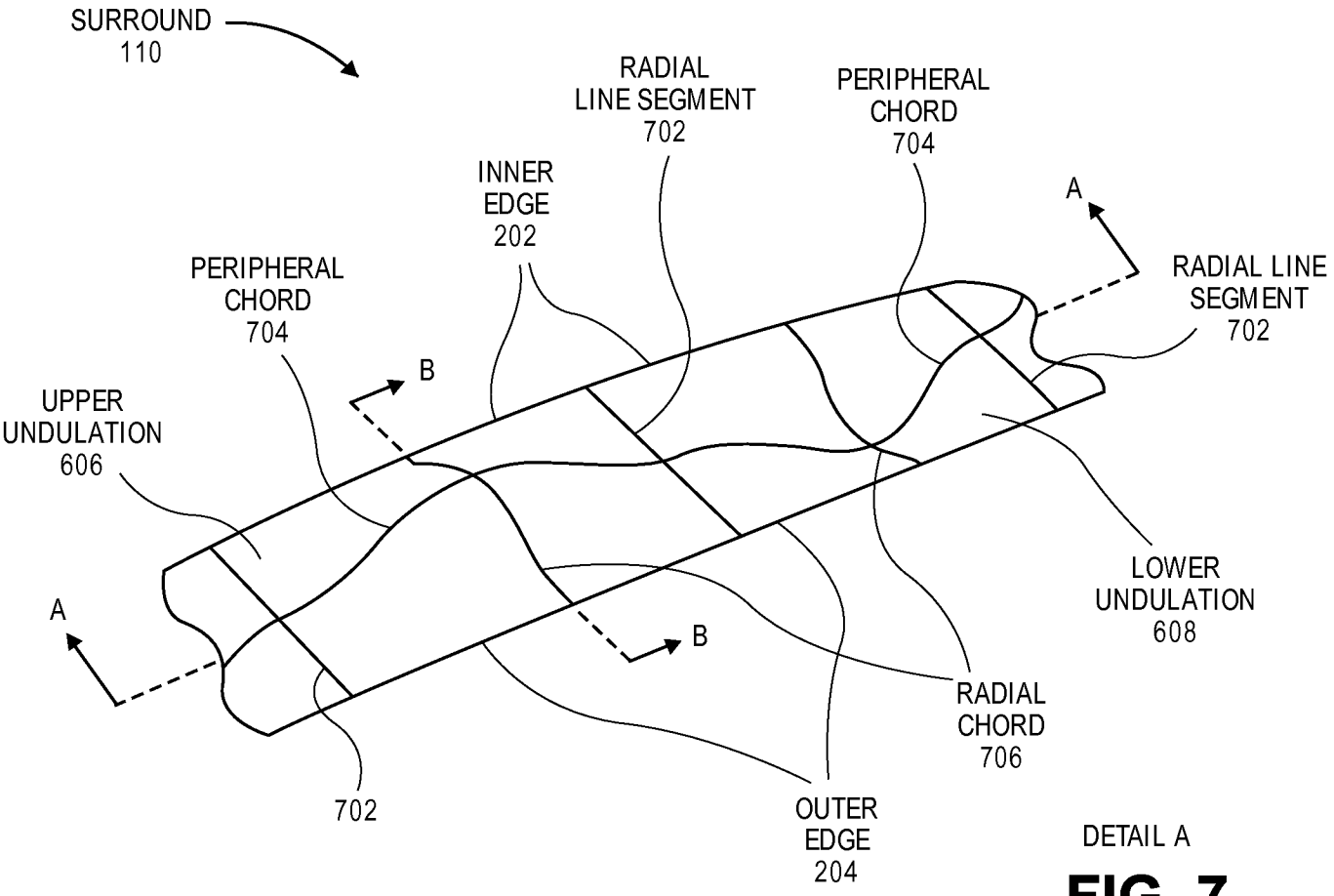
FIG. 7 is a perspective cutaway view, taken from Detail A of FIG. 5, of an undulating portion of a surround in accordance with an embodiment.

Referring to FIG. 7, a perspective cutaway view, taken from Detail A of FIG. 5, of an undulating portion of a surround is shown in accordance with an embodiment. Upper undulation 606 of surround 110 may extend across radial gap 604 and project upward above radial gap 604. More particularly, a surround segment having a single upper undulation 606 may include a surface boundary that is defined between one or more lines that lie on or above radial gap 604 between outer rim 502 and inner rim 504. For example, a surface boundary of upper undulation 606 may include inner edge 202, outer edge 204, and a pair of lines that are separated from each other in the peripheral direction and extend between inner edge 202 and outer edge 204. Such lines may be, for example, a pair of radial line segments 702 that extend straightly between inner edge 202 and outer edge 204. Thus, as in the case where inner edge 202 and outer edge 204 extend along straight sides of a rectangular diaphragm 108 and frame 102, upper undulation 606 may have a surface boundary that is substantially rectangular. Alternatively, as in the case of a circular diaphragm 108 and frame 102, when inner edge 202 and outer edge 204 are curved with radii matching those of outer rim 502 and inner rim 504, upper undulation 606 may have a surface boundary that is a segment of an annulus. In any case, the surface boundary may include a straight line extending across radial gap 604, and thus, may be aligned or coplanar with radial plane 602. For example, in the case of an audio speaker 100 having a circular diaphragm 108 and a circular frame 102, the surface boundary lines of surround segments 508 may be coplanar within radial plane 602 and may be defined in part by a pair of radial line segments 702 that intersect at central axis 404.

In an embodiment, with the undulation surface boundary forming a base of a surround segment 508, upper undulation 606 may project upward above radial gap 604. Upper undulation 606 may have an upper surface curvature extending across the boundary. For example, the upper surface curvature may be partly defined by a peripheral chord 704 extending between the pair of radial line segments 702 in the peripheral direction, as well as by a radial chord 706 extending between inner edge 202 and outer edge 204 in the radial direction. The chords may partly define a contour of a concave downward surface curvature extending above radial gap 604.

Surround 110 may include a surround segment 508 having a single lower undulation 608 disposed adjacent to the surround segment 508 having upper undulation 606. More particularly, lower undulation 608 may be immediately adjacent and contiguous with upper undulation 606, or spaced apart from upper undulation 606 in the peripheral direction. Similar to upper undulation 606, lower undulation 608 may include a surface boundary that is defined between one or more lines that lie on or below radial gap 604 between outer rim 502 and inner rim 504. For example, a surface boundary of lower undulation 608 may include inner edge 202, outer edge 204, and a pair of lines extending between inner edge 202 and outer edge 204, e.g., radial line segments 702. With such a surface boundary forming a base of the surround segment 508 having lower undulation 608, lower undulation 608 may have a lower surface curvature extending across the boundary. For example, the lower surface may be partly defined by a peripheral chord 704 extending between the pair of radial line segments 702 in the peripheral direction, and a radial chord 706 extending between inner edge 202 and outer edge 204 in the radial direction. The chords may partly define a contour of a concave upward surface extending below radial gap 604.

Peripheral chords 704 and radial chords 706 of upper undulation 606 and lower undulation 608 may be variously shaped, and thus, the contour of upper or lower surfaces of respective undulations may also have a variety of forms. For example, in an embodiment, each of peripheral chord 704 and radial chord 706 may be multi-segmented line segments, e.g., v-shaped, with apices that meet at a common vertex at the center of the projected boundary area. Accordingly, an upper surface of upper undulation 606 or a lower surface of lower undulation 608 may be pyramidal rather than curved. Alternatively, the upper surface of upper undulation 606 and/or lower surface of lower undulation 608 may include a smooth curvature, defined by peripheral chord 704 and radial chord 706 that are smooth curved lines. Thus, the upper surface and/or the lower surface may include contours that are bulbous or cup-like, as shown in FIG. 7 and described further below.

Figure 8A:
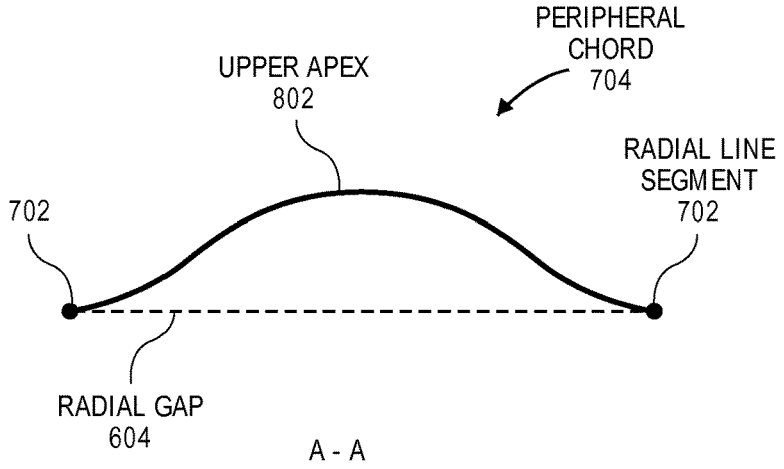
FIGS. 8A-8B are cross-sectional views, taken about a portion of line A-A of FIG. 7, of a surround segment having an upper undulation in accordance with various embodiments.

Referring to FIG. 8A, a cross-sectional view, taken about a portion of line A-A of FIG. 7, of a surround segment having an upper undulation is shown in accordance with an embodiment. In an embodiment, a smooth surface curvature of upper undulation 606 includes a smooth curved peripheral chord 704 extending across the boundary between radial line segments 702 spaced apart in the peripheral direction. The peripheral chord 704, and thus upper undulation 606 along the cross-section, may be located entirely above radial gap 604. Accordingly, the surround segment 508 having upper undulation 606 may have a concave downward shape with an upper apex 802 located at a peak of the upper surface curvature. More particularly, peripheral chord 704 may have a continuous, arcuate shape that progresses smoothly from either end at radial line segments 702 toward upper apex 802 without any bends, angles, or folds along the path.

Figure 8B:
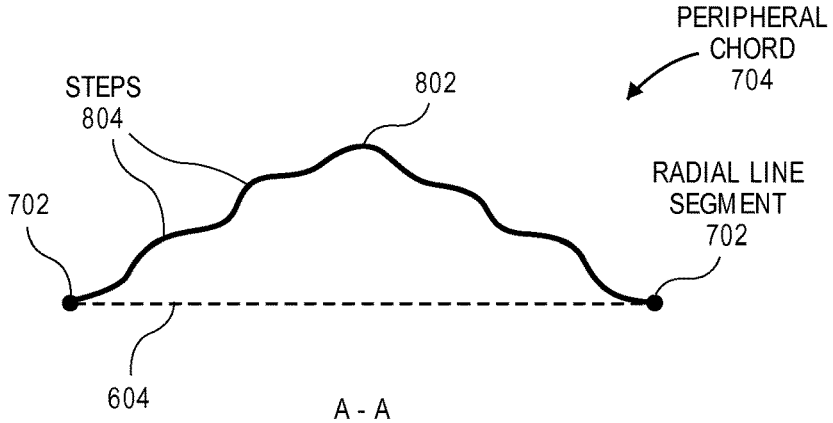

Referring to FIG. 8B, a cross-sectional view, taken about a portion of line A-A of FIG. 7, of a surround segment having an upper undulation is shown in accordance with an embodiment. In an alternative embodiment, peripheral chord 704 of upper undulation 606 may progress in a stepped manner between radial line segment 702 and upper apex 802. For example, peripheral chord 704 may have one or more step 804 between radial line segment 702 and upper apex 802. The peripheral chord 704 may be continuous and smooth along the stepped path, e.g., the path may be curvilinear with discrete bends between steps, or alternatively, the steps 804 may be continuous and non-smooth, i.e., there may be local angulations along a zig-zag path at which points the surface contour of upper undulation 606 may have a corner or fold. Accordingly, the surface contour of the surround segment 508 having upper undulation 606 may be smooth or non-smooth.

Figure 9:
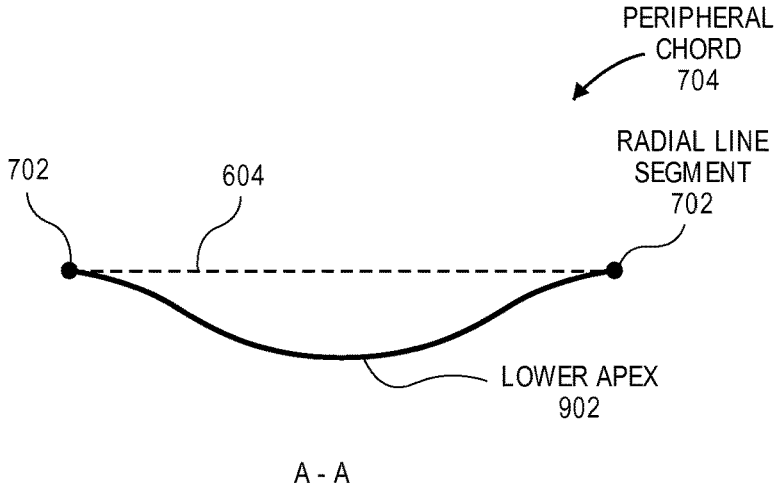
FIG. 9 is a cross-sectional view, taken about a portion of line A-A of FIG. 7, of a surround segment having a lower undulation in accordance with an embodiment.

Referring to FIG. 9, a cross-sectional view, taken about a portion of line A-A of FIG. 7, of a surround segment having a lower undulation is shown in accordance with an embodiment. In an embodiment, a smooth surface curvature of lower undulation 608 includes a smooth curved peripheral chord 704 extending across the boundary between radial line segments 702 spaced apart in the peripheral direction. The peripheral chord 704, and thus lower undulation 608 along the cross-section, may be located below radial gap 604. Accordingly, the surround segment 508 having lower undulation 608 may have a concave upward shape with a lower apex 902 located at a peak (or valley) of the lower surface curvature. More particularly, peripheral chord 704 may have a continuous, arcuate shape that progresses smoothly from either end at radial line segments 702 toward lower apex 902.

Lower undulation 608 may have other contour shapes, such as the curvilinear and/or stepped contour described with respect to upper undulation 606 in FIG. 8B. Thus, upper undulations 606 and lower undulations 608 may be similarly shaped, but oppositely disposed about radial gap 604. For example, upper undulations 606, or chords defining a surface contour of upper undulation 606, may be symmetric with lower undulation 608, or chords defining a surface contour of lower undulation 608, across radial gap 604.

Figure 10:
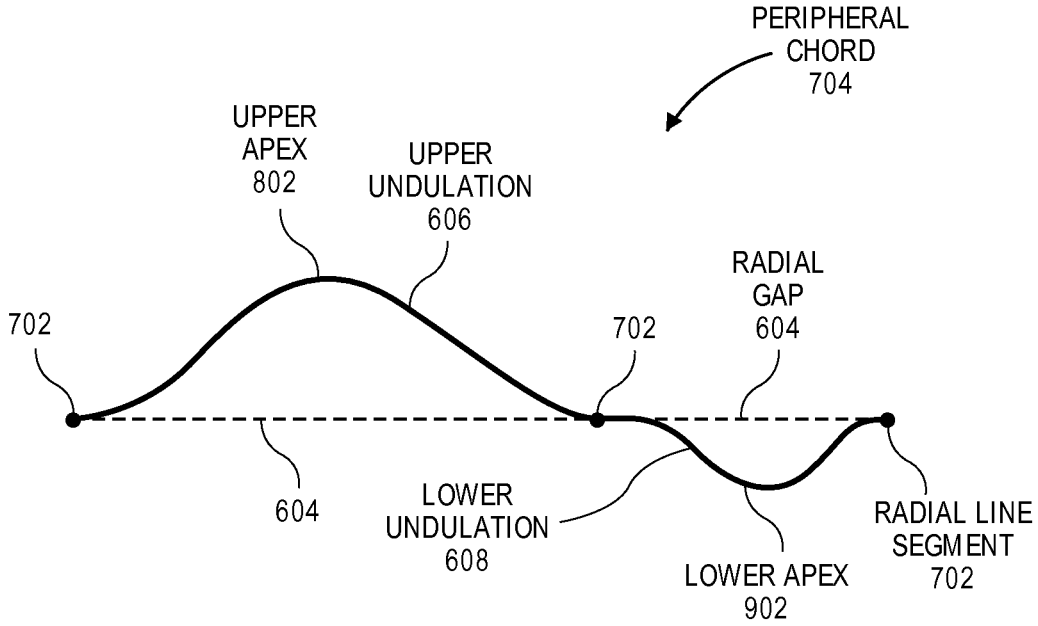
FIG. 10 is a cross-sectional view, taken about a portion of line A-A of FIG. 7, of a surround segment having an upper undulation in series with a surround segment having a lower undulation in accordance with an embodiment.

Referring to FIG. 10, a cross-sectional view, taken about a portion of line A-A of FIG. 7, of a surround segment having an upper undulation in series with a surround segment having a lower undulation is shown in accordance with an embodiment. In an embodiment, upper undulation 606 and lower undulation 608 may not be symmetric across radial gap 604. Peripheral chord 704 may extend contiguously between radial line segments 702 defining a surface boundary of a surround segment 508 having upper undulation 606, and may extend further between radial line segments 702 defining a surface boundary of a surround segment 508 having lower undulation 608. Furthermore, peripheral chord 704 may curve smoothly to upper apex 802 of upper undulation 606 and lower apex 902 of lower undulation 608. However, in an embodiment, upper apex 802 may be above radial gap 604 by an apical distance, i.e., a height between an undulation apex and radial gap 604, which is different than an apical distance of lower apex 902 below radial gap 604. Accordingly, since the apices of upper undulation 606 and lower undulation 608 differ in height relative to radial gap 604, the undulations include different radii and are asymmetric across radial gap 604. For example, a bulbous surface contour of upper undulation 606 may be larger, e.g., have a greater average radius, than a bulbous surface contour of lower undulation 608.

Shaping upper undulations 606 and lower undulations 608 to have asymmetric surface contours across radial gap 604 may allow for surround 110 stiffness to be tuned. For example, creating upper undulations 606 with larger radii, e.g., as in the case where upper apical distances are greater than lower apical distances, may result in upper undulations 606 that are less stiff with respect to loading in a particular direction. More particularly, forming surround segments 508 that are asymmetric across radial gap 604 can allow for surround 110 to be tuned to be more resistant to tilting motion 410 in one direction as compared to tilting motion 410 in another direction. Similarly, creating surround segments 508 that differ in geometry in a peripheral direction, e.g., locating surround segments 508 having upper undulations 606 near corners 507 of surround 110 that include larger radii than upper undulations 606 of surround segments 508 farther from corners 507, may provide for surround 110 that is more or less resistant to tipping or tilting in a particular radial direction, e.g., resists tilting toward diaphragm 108 sides more than tilting toward diaphragm 108 corners. Thus, undulation geometry may vary between upper undulations 606 and lower undulations 608 of different surround segments 508, as well as between undulations of the same class within surround segments 508. For example, some surround segments 508 having upper undulations 606 may have apical distances that differ from other upper undulations 606 of other surround segments 508, and/or respective lower undulations 608 of different surround segments 508 may vary similarly. More particularly, film 506 undulations may be shaped to alter participation of driven mass 402 in a range of different modes of motion. Furthermore, altering contour geometry may alter resonant frequencies of audio speaker 100. For example, surround 110 having surround segments 508 that include upper undulations 606 with larger average radii than other surround segments 508 that include lower undulations 608 may shift the resonant frequencies of audio speaker 100, i.e., the eigenfrequencies, upward. Accordingly, undulation geometry may be altered to tune eigenfrequencies such that modes that dissipate vibrational energy in non-pistonic directions tend to occur within frequency ranges that are less commonly generated during popular music reproduction.

Figure 11:
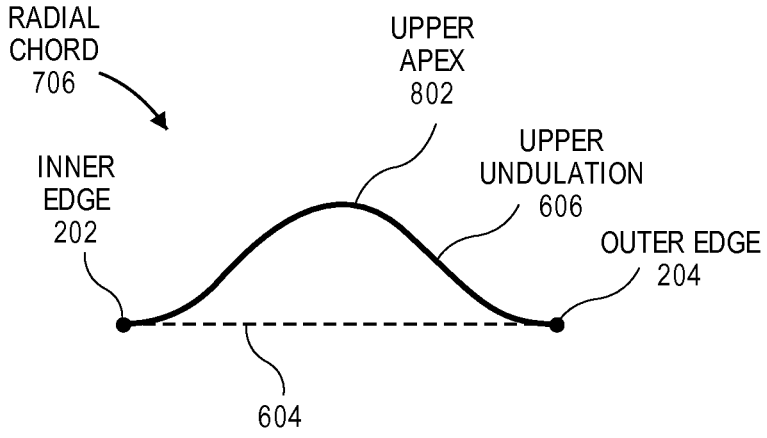
FIG. 11 is a cross-sectional view, taken about line B-B of FIG. 7, of a surround segment having an upper undulation in accordance with an embodiment.

Referring to FIG. 11, a cross-sectional view, taken about line B-B of FIG. 7, of a surround segment having an upper undulation of a surround is shown in accordance with an embodiment. In addition to peripheral chord 704 extending between radial line segments 702 in the peripheral direction, a surface contour of upper undulation 606 may be defined by one or more radial chord 706 extending between inner edge 202 and outer edge 204 in a radial direction. Furthermore, radial chord 706 may have a smooth curved geometry, similar to certain embodiments of peripheral chord 704. Accordingly, in an embodiment, radial chord 706 and peripheral chord 704 may both have smooth curves defining a surface contour with a smooth curvature and upper apex 802 at a location where the peaks of radial chord 706 and peripheral chord 704 meet. Of course, upper undulation 606 may be segmented into numerous radial chords 706 and peripheral chords 704 by taking cross-sections at different locations along the perimeter of outer rim 502 or between inner edge 202 and outer edge 204, and thus, some radial chords 706 and peripheral chords 704 of upper undulation 606 may not meet at upper apex 802. Nonetheless, in an embodiment, every radial chord 706 and peripheral chord 704 of a surround segment 508 may meet at a point that is continuous and smooth on each chord, i.e., there may be no point of intersection between chords that is a vertex of an angle in any direction along the upper surface contour of undulation 606. Alternatively, some regions of the contour may be smooth, e.g., bulbous, while other portions may have folds, e.g., angles or vertices at intersecting surfaces or chords as in the case of a pyramidal surface.

It will be appreciated that the description related to the contour geometry of upper undulation 606 may be equally applied to lower undulation 608 of surround 110. For example, the geometry of upper undulation 606 illustrated in FIG. 11 may be mirrored across radial gap 604 to illustrate a similar geometry of lower undulation 608, and thus, upper undulation 606 and lower undulation 608 may be symmetric in a radial direction across radial gap 604. Alternatively, lower undulation 608 geometry may include radial chord 706 that differs from the radial chord 706 geometry of upper undulation 606, just as peripheral chord 704 geometry was illustrated as being asymmetric along radial gap 604 in the example of FIG. 10. Thus, upper undulation 606 and lower undulation 608 may have some chords that are symmetric across radial gap 604 and other chords that are asymmetric across radial gap 604. A person of ordinary skill in the art may extrapolate from the surround segment 508 geometries described above to arrive at a variety of different undulation surface contours, shapes, and sizes within the scope of this description. Accordingly, a description of every permutation of surround segment 508 geometry is omitted here for conciseness. Certain embodiments, however, are described below beginning at FIG. 15 that fit within the general framework described above. Those embodiments are address after FIGS. 12-14B to avoid unnecessarily obscuring the additional aspects that are described next.

In an embodiment, surround segments 508 of film 506 do not overlap with one another around outer rim 502. For example, although a surround segment 508 having upper undulation 606 and another surround segment 508 having lower undulation 608 may be adjacent, and in some cases immediately adjacent as shown in FIG. 7, the surface boundaries that define upper undulation 606 and lower undulation 608 may not overlap along the peripheral direction. Since the surface boundaries of each surround segment 508 may be defined by those lines around the respective undulation that forms a base of surround segment 508 lying within radial plane 602, the surface boundaries of nonoverlapping upper undulation 606 and lower undulation 608 may not both be intersected by the same straight radial line segment extending between inner edge 202 and outer edge 204. More particularly, whereas the radial line segments 702 defining upper undulation 606 and lower undulation 608 may include a same radial line segment 702, such as the middle radial line segment 702 shown between immediately adjacent upper undulation 606 and lower undulation 608 in FIG. 7, no portion of upper undulation 606 lies on the lower undulation 608 side of the middle radial line segment 702 and no portion of lower undulation 608 lies on the upper undulation 606 side of the middle radial line segment 702. Furthermore, upper undulation 606 and lower undulation 608 may be nonoverlapping in an embodiment in which at least one straight radial line segment 702 extends between inner edge 202 and outer edge 204 at a peripheral location between adjacent surround segments 508. Accordingly, upper undulation 606 and lower undulation 608 of FIG. 7 may be considered to be nonoverlapping, since a single straight radial line segment is located between adjacent undulations.

It will be apparent then from the description above that surround segments 508 having upper undulations 606 and surround segments 508 having lower undulations 608 may be arranged sequentially in the peripheral direction around outer rim 502. More particularly, around the perimeter of diaphragm 108, film 506 may periodically rise and fall in a wave-like, up and down, undulating manner. Thus, in an embodiment, each surround segment 508 having an upper undulation 606 of film 506 may be separated from other surround segments 508 having other upper undulations 606 by one or more surround segment 508 having a lower undulation 608. For example, at least one lower undulation 608 may be disposed between each pair of upper undulations 606 of film 506. Similarly, each lower undulation 608 of film 506 may be separated from other lower undulations 608 by one or more upper undulations 606. For example, at least one upper undulation 606 may be disposed between each pair of lower undulations 608. Accordingly, surround segments 508 of film 506 may be arranged in a series in the peripheral direction such that each upper undulation 606 is followed by a lower undulation 608, each lower undulation 608 is followed by an upper undulation 606, and so on.

In an embodiment, sequentially arranged surround segments 508 may have respective chords that are contiguous with one another. For example, a peripheral chord 704 of an upper undulation 606 may meet a peripheral chord 704 of a lower undulation 608 at a radial line segment 702 shared by the sequential surround segments 508. That is, the peripheral chord 704 of the upper undulation 606 may intersect radial gap 604 on the radial plane 602 at the same location that the peripheral chord 704 of the lower undulation 608 intersects the radial gap 604. Accordingly, the immediately adjacent surround segments 508 may be contiguous in the peripheral direction, since the surround segments 508 meet along the same radial line segment 702. In an embodiment, the surround segments 508 may be contiguous along the entire length of the shared radial line segment 702. Alternatively, the surround segments 508 may be contiguous, i.e., share a surface boundary line over a portion of the length between inner edge 202 and outer edge 204, and the undulation boundaries may be separated from each other over another portion of the length between inner edge 202 and outer edge 204.

Figure 12:
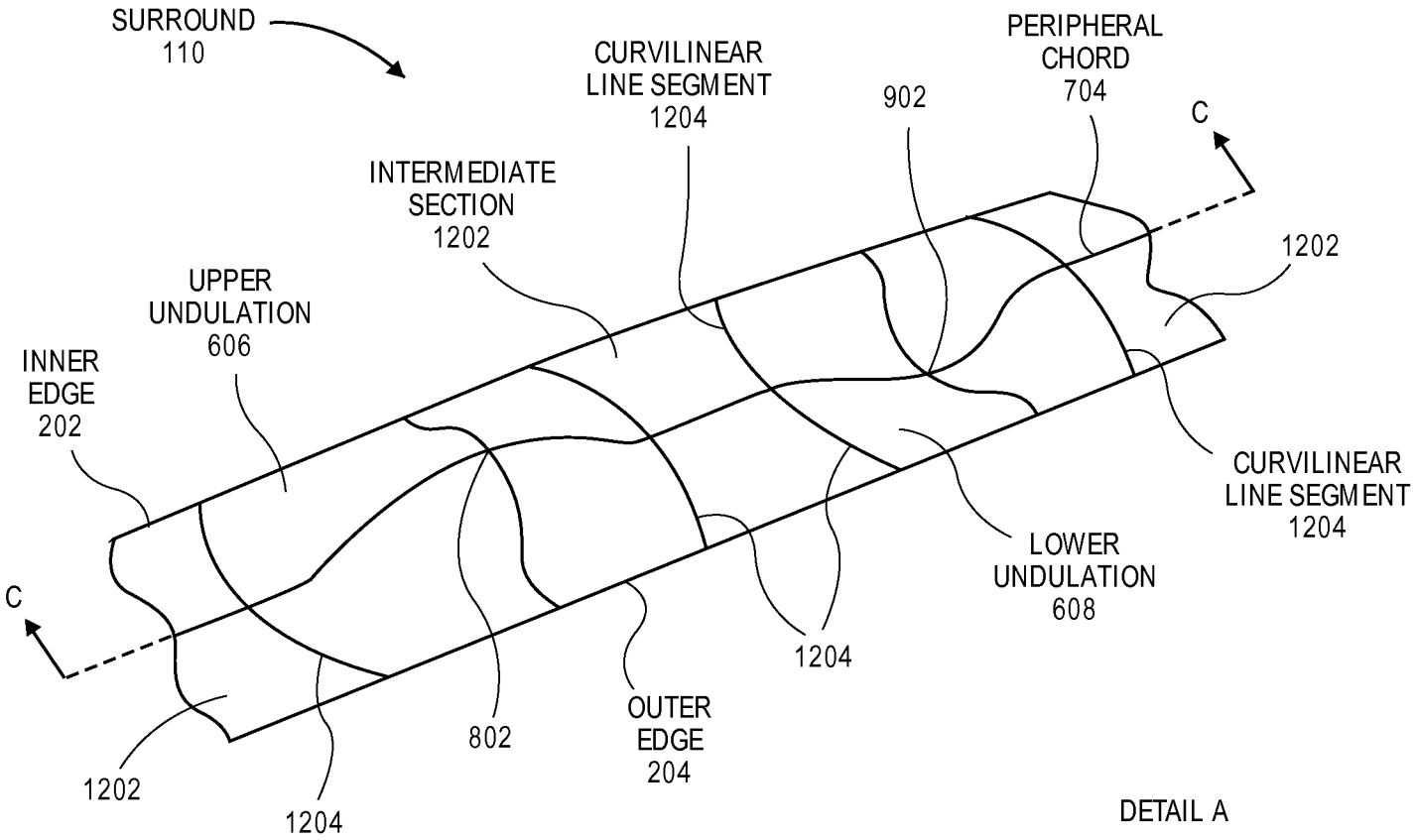
FIG. 12 is a perspective cutaway view, taken from Detail A of FIG. 5, of an undulating portion of a surround in accordance with an embodiment.

Referring to FIG. 12, a perspective cutaway view, taken from Detail A of FIG. 5, of an undulating portion of a surround is shown in accordance with an embodiment. In an embodiment, surround segment 508 having upper undulation 606 and surround segment 508 having lower undulation 608 may be nonoverlapping with each other and spaced apart in the peripheral direction. For example, similar to the embodiment illustrated in FIG. 7, upper undulation 606 and lower undulation 608 may include surface boundaries defined between inner edge 202, outer edge 204, and a respective pair of radial line segments 702. Unlike FIG. 7, however, rather than upper undulation 606 and lower undulation 608 being immediately adjacent such that each surface boundary shares a middle radial line segment 702, respective radial line segments 702 may be separated by an intermediate section 1202. Intermediate section 1202 may include a surface boundary having a radial width defined between inner edge 202 and outer edge 204. The boundary may further include respective radial line segments 702 of adjacent surround segments 508. In an embodiment, intermediate section 1202 may be flat. For example, peripheral chords 704 and radial chords 706 through intermediate section 1202 may be straight line segments, i.e., straight peripheral line segments or straight radial line segments, such that intermediate section 1202 does not rise above or below radial gap 604, but rather, is a flat film portion extending across radial plane 602 in the peripheral direction along radial gap 604.

Still referring to FIG. 12, in an embodiment, with surround segments 508 separated from each other in the peripheral direction by intermediate sections 1202, radial line segments 702 may not extend straightly between inner edge 202 and outer edge 204, but rather, radial line segments 702 may include curvilinear line segments 1204 extending between inner edge 202 and outer edge 204. More particularly, curvilinear line segments 1204 may include arcuate line segments that curve from inner edge 202 to outer edge 204 in a generally radial direction to define an hourglass-shaped intermediate section 1202. Curvilinear line segments 1204 may bow outward toward an adjacent undulation, e.g., reaching a curve peak at peripheral chord 704. Alternatively, curvilinear line segment 1204 may bow inward, e.g., toward a radial chord 706 passing through upper apex 802 or lower apex 902 of the respective surround segment 508. Thus, radial line segments 702 bounding surround segments 508 need not be straight, but may be curved such that adjacent surround segments 508 do not overlap. That is, nonoverlapping surface boundaries of adjacent surround segments 508 may not be intersected by a straight radial line extending from inner edge 202 to outer edge 204. Even more particularly, any cross-section taken about a radial line through film 506 may include a profile that is above or below radial gap 604, but not both above and below radial gap 604. As such, in an embodiment, no radial cross-section may show both a portion of upper undulation 606 and a portion of lower undulation 608. Furthermore, such profiles may include either a straight line segment or a smooth curvilinear chord between inner edge 202 and outer edge 204, but in an embodiment, the profiles do not include a multi-segmented line with one or more angles between segments extending between inner edge 202 and outer edge 204.

Figure 13:
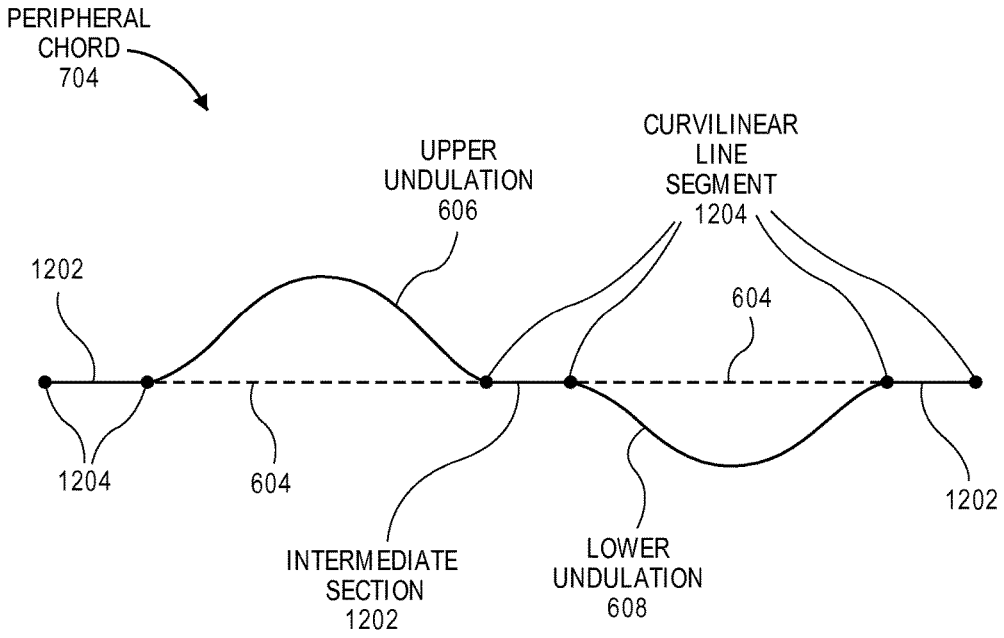
FIG. 13 is a cross-sectional view, taken about line C-C of FIG. 12, of a surround segment having an upper undulation separated from a surround segment having a lower undulation by an intermediate section in accordance with an embodiment.

Referring to FIG. 13, a cross-sectional view, taken about line C-C of FIG. 12, of a surround segment having an upper undulation separated from a surround segment having a lower undulation by an intermediate section is shown in accordance with an embodiment. Surround segment 508 having upper undulation 606 and surround segment 508 having lower undulation 608 may be arranged sequentially in the peripheral direction along radial gap 604, but may be separated from each other along at least one peripheral chord 704 by intermediate section 1202. As shown, intermediate section 1202 may be flat in the peripheral direction, i.e., the cross-section along peripheral chord 704 may be straight between curvilinear line segments 1204 lying on radial gap 604. Thus, while a surface curvature of upper undulation 606 may be entirely above radial gap 604 and a surface curvature of lower undulation 608 may be entirely below radial gap 604, intermediate section 1202 between surround segments 508 may have a length in the peripheral direction, i.e., a peripheral line segment between radial line segments 702, along radial gap 604. Lengths of peripheral line segments may vary across intermediate section 1202, as in the case of an hourglass-shaped intermediate section 1202 having adjacent curvilinear line segments 1204 that are nearer to each other at the middle of the hourglass than at inner edge 202 and outer edge 204. In at least one location, the curvilinear line segments 1204 may touch, making the peripheral length zero at that point where the immediately adjacent surround segments 508 are contiguous and nonoverlapping. In an embodiment, a maximum length of any peripheral line segment of intermediate section 1202 may be less than 20 mm, and in some cases less than 15 mm. For example, intermediate section 1202 may have a maximum length between radial line segments 702 defining its boundary, e.g., curvilinear line segments 1204, of less than 10 mm.

Figure 14A:
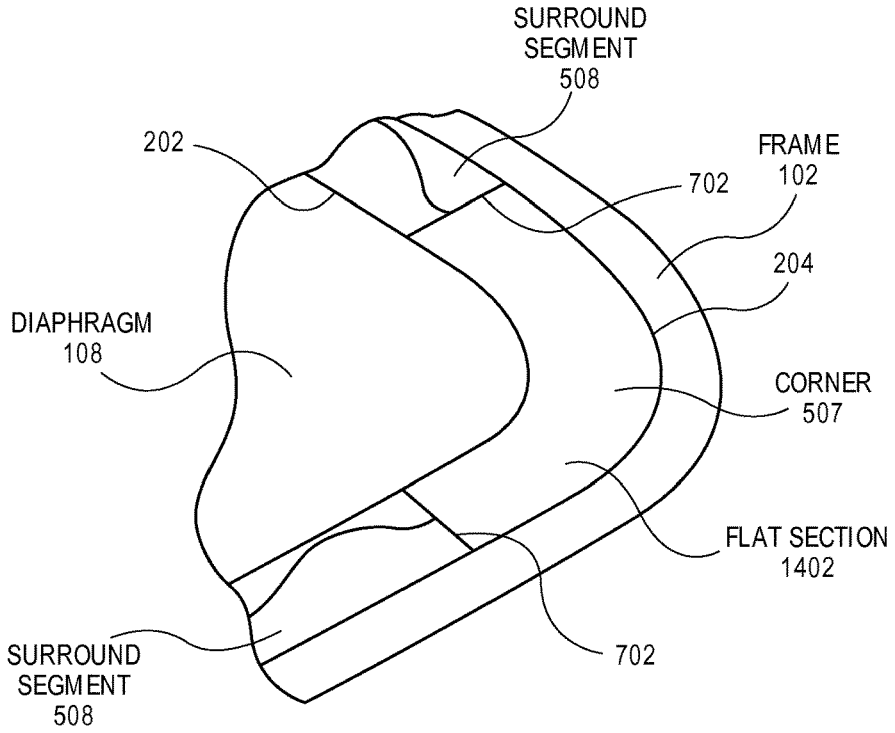
FIGS. 14A-14B are perspective cutaway views of a corner region of a surround in accordance with various embodiments.

Referring to FIG. 14A, a perspective cutaway view of a corner region of a surround is shown in accordance with an embodiment. Surround 110 may include film 506 that does not have surround segments 508 along a corner 507 region around a corner of diaphragm 108. More particularly, surround segments 508 on either side of corner 507 region of film 506 may be bounded by respective radial line segments 702 and those radial line segments 702, as well as inner edge 202 and outer edge 204 between diaphragm 108 and frame 102, may define a surface boundary of a flat section 1402 around corner 507 region. Flat section 1402 of film 506 may have a same thickness of surround segments 508, or in an alternative embodiment, may be thinner or thicker than surround segments 508. Thus, flat section 1402 may be more or less prone to deformation under different modes of motion, based on the differences in cross-section profiles between flat section 1402 and, e.g., an adjacent surround segment 508.

Figure 14B:
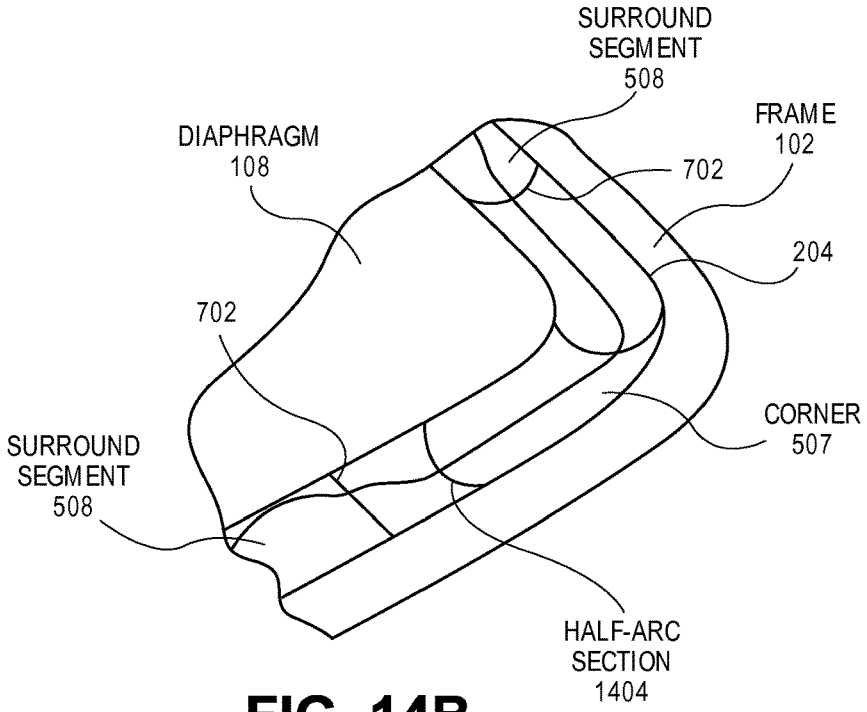

Referring to FIG. 14B, a perspective cutaway view of a corner region of a surround is shown in accordance with an embodiment. In an embodiment, surround 110 includes film 506 having corner 507 region that includes a half-arc section 1404. For example, a length of film 506 between radial line segments 702 on either side of corner 507 region may have a cross-sectional profile similar to half-arc 206 profile shown in FIG. 2. The half-arc profile may extend below or above radial gap 604. As with flat section 1402, half-arc section 1404 may influence how stress is distributed throughout film 506. More particularly, including half-arc section 1404 along corner 507 region may cause stress to distribute throughout the portions of film 506 having surround segments 508. For example, in the case of a rectangular diaphragm 108, stress generated by various rocking modes may distribute primarily along the straight sides of film 506 having sequential surround segments 508 that include upper undulations 606 and lower undulations 608. Minimal stress may be distributed through film 506 around corner 507 region within half-arc section 1404 in such a case. More particularly, in an embodiment, film 506 having no undulations in the corner 507 regions may promote balanced motion at all resonant frequencies of audio speaker 100 by shifting control of motion-induced stresses to the surround segments 508 along the sides instead of to the half-arc 206 profiles in the corner 507. Accordingly, surround 110 having film 506 with surround segments 508 as described above may cause driven mass 402 of audio speaker 100 to behave quite differently with respect to rocking modes.

In an embodiment, film 506 may have no corner region. For example, an outer rim of diaphragm 108 and an inner rim of frame 102 may both be circular, and thus, film 506 may have an annular structure with an inner and outer radius. Nonetheless, stresses may distribute in surround segments 508 along the annular structure of surround 110 to promote balanced motion at all resonant frequencies.

Just as the cross-sectional profiles of surround segments 508 may vary, so may the cross-sectional profiles of corner segments vary, too. For example, a cross-sectional profile of a radial cross-section taken through a corner segment of surround 110 may be sinusoidal. In an embodiment, the surface morphology of the corner segments is smooth and continuous. That is, cross-sectional profiles taken through the corner segments may include a radial chord that is continuous and progresses smoothly from inner edge 202 to outer edge 204, without any bends, angles, or folds along the path.

Figure 15:
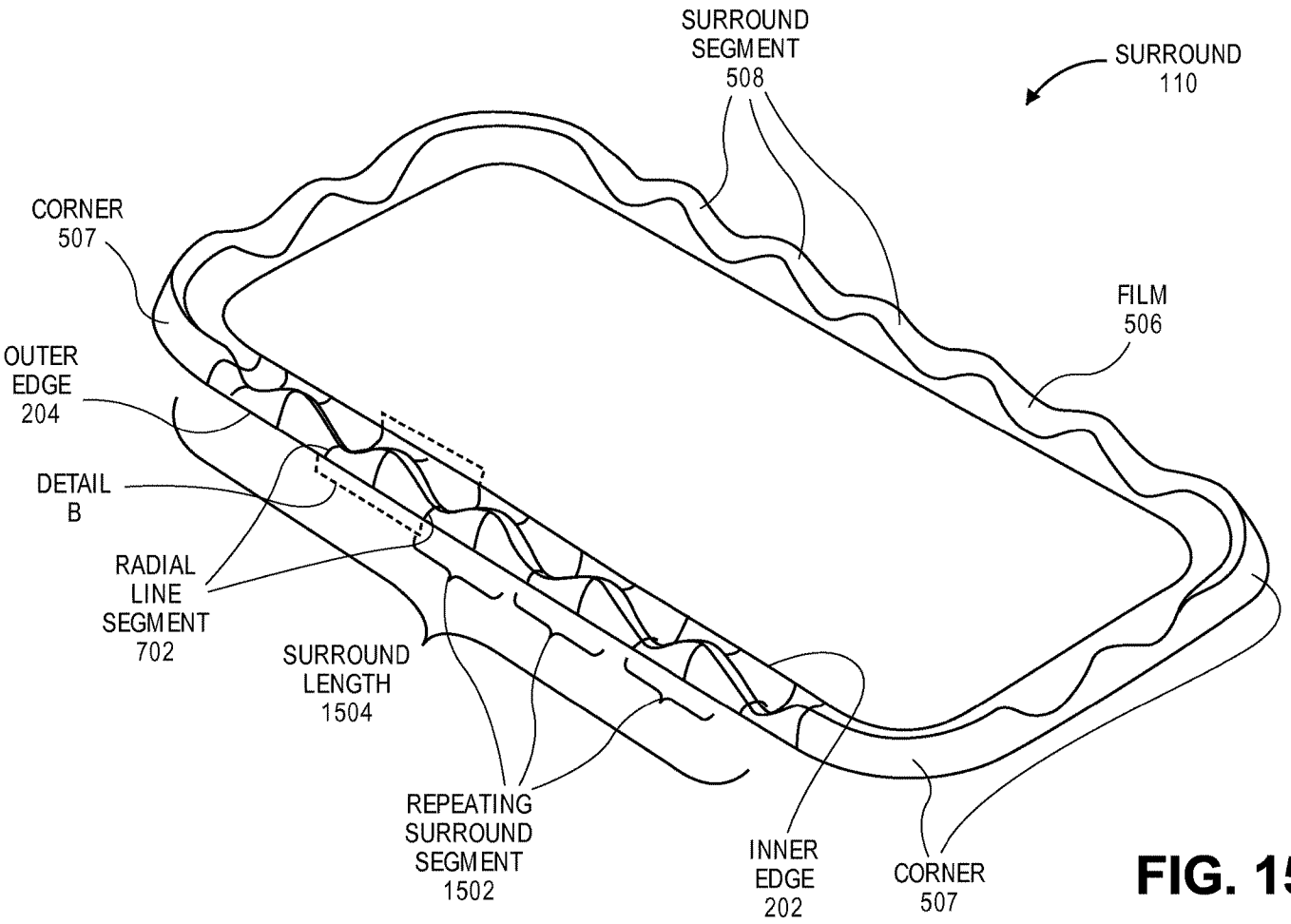
FIG. 15 is a perspective view of an audio speaker surround in accordance with an embodiment.

Referring to FIG. 15, a perspective view of an audio speaker surround is shown in accordance with an embodiment. In an embodiment, audio speaker 100 includes a suspension system, e.g., a single-suspension system, having surround 110 connecting a diaphragm with a frame (not shown). As described above, the diaphragm, e.g., diaphragm 108, may include a rigid member having circular, rectangular, or any other shaped outer rim. Furthermore, the frame, e.g., frame 102, may include an inner rim shaped similar to the diaphragm outer rim, and the inner rim may be separated from the outer rim by a radial gap. Thus, surround 110 may be connected to the outer rim at an inner edge and may be connected to the inner rim at an outer edge 204 that is separated from the inner edge 202 along a radial plane to provide a suspension between the diaphragm and the frame across the radial gap. Accordingly, surround 110 may be an essentially circular, rectangular, or otherwise-shaped ring having an inner edge 202 with an inner perimeter and an outer edge 204 with an outer perimeter, and having a film thickness along a peripheral path between the edges. The film thickness may be constant or may vary in the peripheral or radial direction. For example, the film may be thicker at the inner and outer perimeters than at a location between inner edge 202 and outer edge 204, or vice versa.

As described above, the radial gap may extend across a radial plane 602 that is intersected by a central axis of diaphragm 108 and passes in a radial direction between the outer rim 204 of diaphragm 108 and the inner rim 202 of frame 102. As such, film 506 may extend across the radial gap, e.g., radial gap 604, to provide a hermetic barrier between a space above radial plane 602 and a space below radial plane 602 across radial gap 604. The hermetic barrier may be provided by hermetically sealing inner edge 202 to the outer rim of diaphragm 108 and outer edge 204 to the inner rim of frame 102 using adhesive or welding, as is known in the art.

Surround 110 may include a film 506 formed in part from a thin flexible sheet extending along the radial gap 604 between the inner edge 202 and the outer edge 204 and having a radial width along radial plane 602. At least a portion of film 506 may undulate in the peripheral direction such that cross-sections of film 506 taken immediately adjacent to one another are not identical. Accordingly, film 506 may include several surround segments 508 that are periodically and/or sequentially arranged in the peripheral direction around at least a portion of the outer rim of diaphragm 108.

Film 506 may be formed from a thin, single-layered or multi-layered material. Furthermore, film 506 may be formed from a flexible material, such as soft rubber or another elastomeric material. In another embodiment, film 506 may be formed from more rigid materials. For example, film 506 may include several laminated layers of an inelastic material. More particularly, by way of example, film 506 may include a lamination foil of polyether ether ketone (PEEK) capable of elastically deforming in a range of 3-5%.

In an embodiment, the surround segments 508 may include several repeating surround segments that include essentially identical surface morphologies. For example, the surround segments 508 may include a repeating surround segment 1502 with an essentially identical surface contour compared to one or more other repeating surround segments 1502 of film 506. The surface contour of repeating surround segment 1502 may extend across a surface boundary defined between inner edge 202 and outer edge 204 that are spaced apart from each other in a radial direction along radial plane 602 across radial gap 604, as well as a pair of radial line segments 702 that are spaced apart from each other in the peripheral direction. In an embodiment, every surround segment 508 along surround length 1504 between adjacent corners 507 may be one of several repeating surround segments 1502, i.e., may have the same surface contour of repeating surround segments 1502. In an embodiment, the entire length of film 506 may include repeating surround segments 1502, e.g., as in the case of an annular film 506 having circular inner edge 202 and outer edge 204 without discrete corners. In FIG. 15, detailed contour lines are only shown for the repeating surround segments 1502 along surround length 1504, to avoid obscuring the drawing, and one or more of the surround segments 508 not on surround length 1504 may have the same surface morphology of repeating surround segment 1502. In another embodiment, surround segments 508 along surround length 1504 or around the entire length of film 506 may have surface contours that vary, or are asymmetric, as described above.

Repeating surround segments 1502 of surround 110 may include several undulations, and in an embodiment, these undulations may be further described as including one or more upper undulation 606 and one or more lower undulation 608. Upper undulations 606 may be formed in film 506 above radial gap 604, e.g., on a front side of radial plane 602 along which radial gap 604 lies between inner edge 202 and outer edge 204. Similarly, lower undulations 608 may be formed in film 506 below radial gap 604, e.g., on a rear side of radial plane 602. Thus, upper undulations 606 and lower undulations 608 may have respective heights on opposite sides of radial gap 604. Accordingly, in an embodiment, undulations of repeating surround segments 1502 may include all of the same aspects as described above with respect to surround segments 508. For example, in some cases immediately adjacent repeating surround segments 1502 may include respective undulations (either upper or lower undulations) that do not overlap along the peripheral direction. That is, in an embodiment, no portion of an upper undulation of a repeating surround segment 1502 lies on the same side of a radial line segment as a lower undulation. Accordingly, one skilled in the art will recognize that the description pertaining to FIGS. 15-17C below mesh conceptually with the description above. One skilled in the art, however, will recognize certain differences between the following embodiments and some of the embodiments described above. For example, as described below, in some embodiments, a surround 110 may include surround segments 508 having cross-sections taken about a radial line through film 506 that may include a profile that is both above and below radial gap 604, i.e., a surround segment 508 may include both an upper undulation 606 and a lower undulation 608 radially beside each other.

Figure 16:
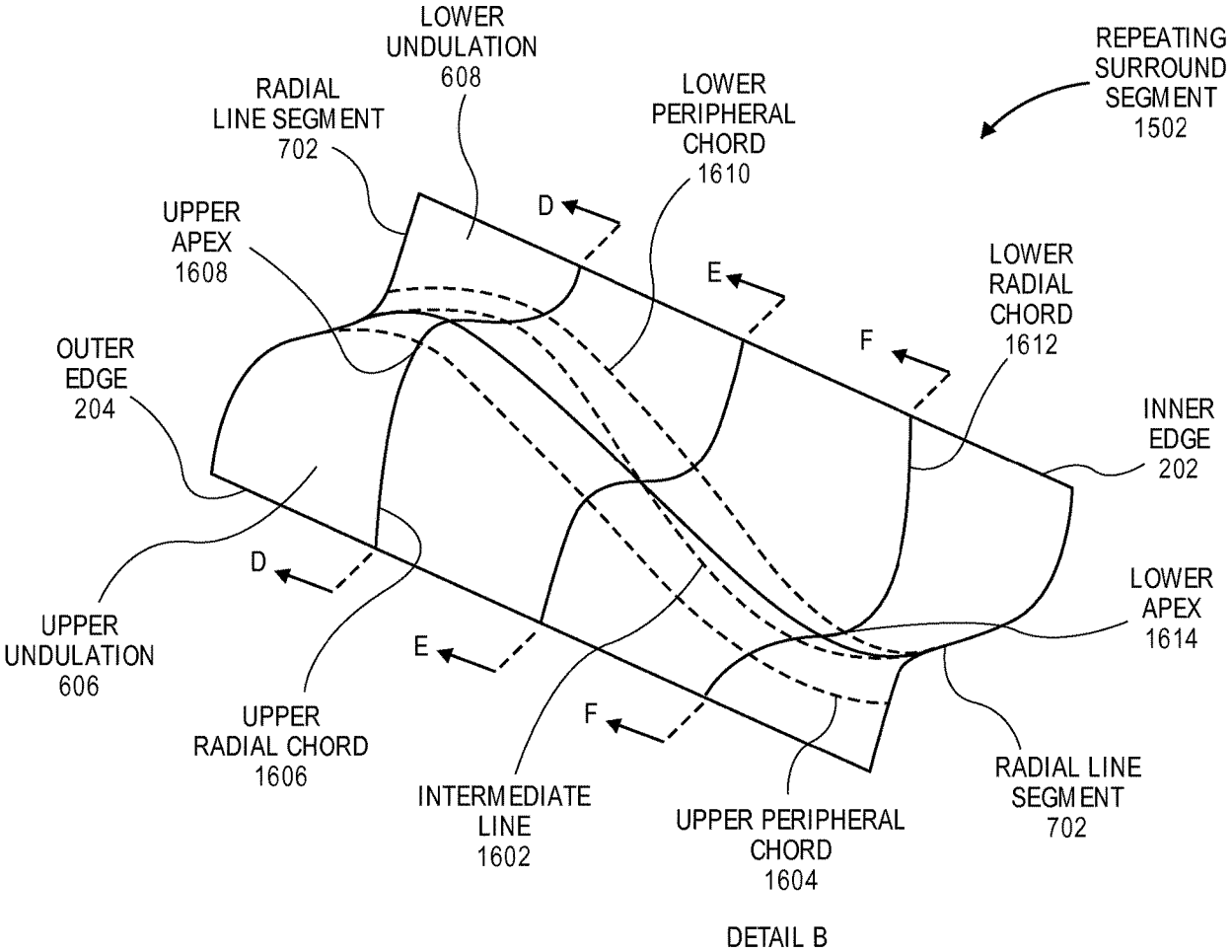
FIG. 16 is a perspective cutaway view, taken from Detail B of FIG. 15, of a repeating surround segment having an upper undulation and a lower undulation in accordance with an embodiment.

Referring to FIG. 16, a perspective cutaway view, taken from Detail B of FIG. 15, of a repeating surround segment having an upper undulation and a lower undulation is shown in accordance with an embodiment. Repeating surround segment 1502 may include a surface boundary defined by inner edge 202, outer edge 204, and a pair of radial line segments 702 extending across radial gap 604 from inner edge 202 to outer edge 204. Radial line segments 702 are separated in the peripheral direction. In an embodiment, the radial line segments 702 intersect an intermediate line 1602 that is disposed between inner edge 202 and outer edge 204 and extends over a surface of repeating surround segment 1502. For example, intermediate line 1602 may extend over the surface along radial plane 602. More particularly, intermediate line 1602 may run generally in the peripheral direction to define a contour line where radial plane 602 intersects the undulating surface of film 506. Thus, at any point, intermediate line 1602 may have a peripheral and/or radial component.

Repeating surround segment 1502 may include one or more upper undulations above radial gap 604 and one or more lower undulations below radial gap 604. The undulations may be arranged beside each other. For example, in an embodiment, repeating surround segment 1502 includes upper undulation 606 above radial gap 604 on a first side of intermediate line 1602, e.g., upper undulation 606 may extend between intermediate line 1602 and outer edge 204 and have a height above radial gap 604. Furthermore, in an embodiment, repeating surround segment 1502 includes lower undulation 608 below radial gap 604 on a second side of intermediate line 1602, e.g., lower undulation 608 may extend between intermediate line 1602 and inner edge 202 and have a height below radial gap 604. Thus, upper undulation 606 may be radially separated from lower undulation 608 by intermediate line 1602. Alternatively, upper undulation 606 may extend between intermediate line 1602 and inner edge 202, and lower undulation 608 may extend between intermediate line 1602 and outer edge 204. In any case, upper undulation 606 and lower undulation 608 of a same repeating surround segment 1502 may be arranged side-by-side.

Upper undulation 606 and lower undulation 608 may have respective surface contours extending across the surface boundary of repeating surround segment 1502, and in an embodiment, the respective surface contours may be smooth. That is, as described above, the surface contours of respective undulations may include smooth curvatures extending smoothly across the surface boundary between a respective inner edge 202 or outer edge 204, and intermediate line 1602. Smoothly extending surface contours may be contrasted with non-smooth contours that include local angulations, corners, or folds.

In an embodiment, upper undulation 606 may include an upper peripheral chord 1604 extending continuously and smoothly in the peripheral direction along the surface of repeating surround segment 1502. Upper peripheral chord 1604 may define a surface contour between intermediate line 1602 and outer edge 204, i.e., on the surface curvature of upper undulation 606. Upper peripheral chord 1604 may intersect an upper radial chord 1606 at an upper apex 1608 of upper undulation 606. Upper apex 1608 may have an upper apical distance, i.e., a height above radial plane 602, that is greater than a distance between radial plane 602 and any other point along the surface of upper undulation 606 on repeating surround segment 1502.

In an embodiment, lower undulation 608 may include a lower peripheral chord 1610 extending smoothly in the peripheral direction along the surface of repeating surround segment 1502. Lower peripheral chord 1610 may define a surface contour between intermediate line 1602 and inner edge 202, i.e., on the surface curvature of lower undulation 608. Lower peripheral chord 1610 may intersect a lower radial chord 1612 at a lower apex 1614 of lower undulation 608. Lower apex 1614 may have a lower apical distance, i.e., a height below radial plane 602, that is greater than a distance between radial plane 602 and any other point along the surface of lower undulation 608 on repeating surround segment 1502.

In an embodiment, upper peripheral chord 1604 and lower peripheral chord 1610 extend over the surface of repeating surround segment 1502 on opposite sides of intermediate line 1602. Thus, upper apex 1608 and lower apex 1614 may be radially offset from one another on opposite sides of intermediate line 1602. More specifically, upper apex 1608 and lower apex 1614 may not be at a same radial distance from central axis 404, and thus, may not be aligned along a same peripheral chord running in a peripheral direction along repeating surround segment 1502 or surround 110. In addition to being radially offset, upper apex 1608 and lower apex 1614 of a same repeating surround segment 1502 may be offset in a peripheral direction as shown (no radial chord runs through both upper apex 1608 and lower apex 1614). Alternatively, the apices may be peripherally aligned, i.e., a radial chord may run through both upper apex 1608 and lower apex 1614.

The surface curvature of upper undulation 606 and the surface curvature of lower undulation 608 may intersect along intermediate line 1602. In an embodiment, the curvatures meet at a same distance from inner edge 202 and outer edge 204 around the entire length of surround 110. The intersection of the upper surface curvature of upper undulation 606 and the lower surface curvature of lower undulation 608 may provide a contiguous surface curvature extending across the surface boundary of repeating surround segment 1502. Furthermore, in an embodiment, the contiguous surface curvature may be continuous and smooth, e.g., any radial or peripheral chord along the contiguous surface curvature may be either straight or curvilinear, i.e., there may be no local angulations, corners, or folds along the surface where upper undulation 606 and lower undulation 608 meet at intermediate line 1602. A surface curvature with continuous and smooth peripheral and radial chords, i.e., without a zig-zag or angulated transition between undulation regions may reduce stress in surround 110 materials, as compared to a surround that includes folds or corners between undulation transitions. Thus, surround 110 having a contiguous and smooth surface contour may experience improved fatigue life.

Figure 17A:
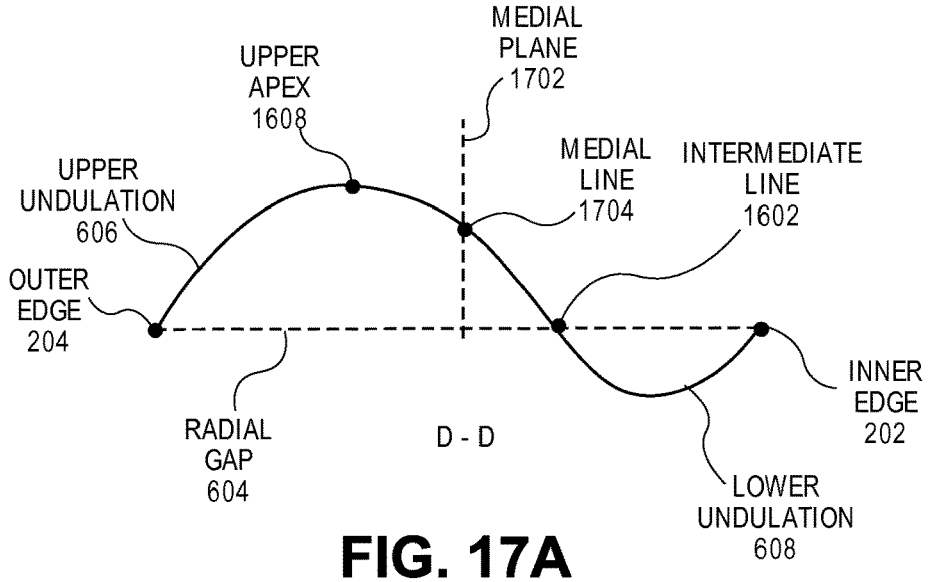
FIGS. 17A-17C are cross-sectional views, taken about lines D-D, E-E, and F-F of FIG. 16, of a repeating surround segment having an upper undulation and a lower undulation in accordance with an embodiment.

Referring to FIG. 17A, a cross-sectional view, taken about line D-D of FIG. 16, of a repeating surround segment having an upper undulation and a lower undulation is shown in accordance with an embodiment. Upper apex 1608 is located at a maximum apical distance from radial gap 604 on an outer edge 204 side of a medial plane 1702. In an embodiment, medial plane 1702 is a plane that is normal to radial gap 604, i.e., normal to radial plane 602, and extends in a peripheral direction at a consistent distance between inner edge 202 and outer edge 204 around an entire length of surround 110. For example, medial plane 1702 may intersect radial plane 602 half way between inner edge 202 and outer edge 204. A medial line 1704 define a surface contour of repeating surround segment 1502 at a location where the surface of 1502 intersects medial plane 1702. For example, medial line 1704 may extend in a peripheral direction from a point on the surface that is radially equidistant from inner edge 202 and outer edge 204.

In an embodiment, intermediate line 1602 runs along the surface of repeating surround segment 1502 at a location where upper undulation 606 and lower undulation 608 meet at radial gap 604. That is, intermediate line 1602 may be a contour line that separates upper undulation 606 from lower undulation 608 at radial plane 602. A cross-section taken through surround 110 through upper apex 1608 may coincide with a portion of surround 110 where the radial width of upper undulation 606 is greater than the radial width of lower undulation 608, and thus, intermediate line 1602 may be located between medial plane 1702 and inner edge 202. Furthermore, when viewed from above, intermediate line 1602 may follow a curvilinear, e.g., a sinusoidal, path along radial plane 602. Thus, a radial slice through upper apex 1608 may intersect intermediate line 1602 at a point of inflection, meaning that the radial direction of a follower moving along intermediate line 1602 in a peripheral direction may change from moving toward inner edge 202 to moving toward outer edge 204. That is, a tangent of intermediate line 1602 along radial plane 602 may extend in the peripheral direction with no slope in the radial direction. In any case, repeating surround segment 1502 includes both an upper undulation 606 above radial gap 604 and a lower undulation 608 below radial gap 604, and the upper and lower undulations may be radially arranged on opposite sides of intermediate line 1602.

Figure 17B:
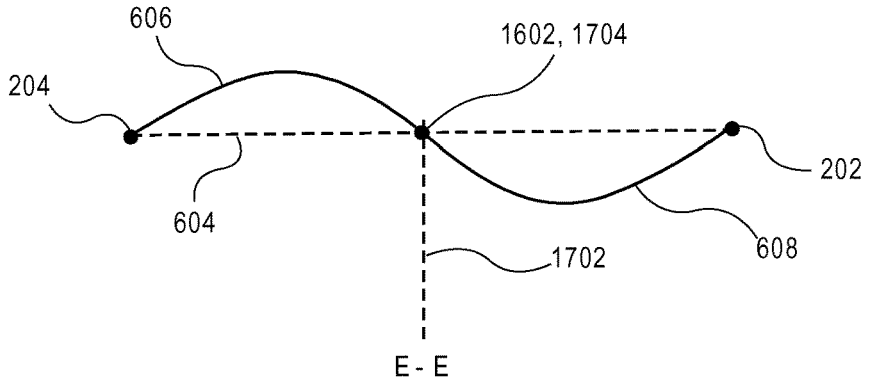

Referring to FIG. 17B, a cross-sectional view, taken about line E-E of FIG. 16, of a repeating surround segment having an upper undulation and a lower undulation is shown in accordance with an embodiment. A radial cross-section taken through a portion of repeating surround segment 1502 at which medial line 1704 and intermediate line 1602 coincide may include upper undulation 606 and lower undulation 608 having equivalent radial widths. For example, upper undulation 606 may extend from outer edge 204 to intermediate line 1602 at medial plane 1702, lower undulation 608 may extend from inner edge 202 to intermediate line 1602 at medial plane 1702, and the radial distances between medial plane 1702 and both edges may be equal. Furthermore, at such a location, the apical distances, i.e., the heights relative to radial gap 604, of both upper undulation 606 and lower undulation 608 may be equal. Thus, in an embodiment, a radial cross-section through a location of repeating surround segment 1502 includes upper undulation 606 that is symmetric with lower undulation 608 across radial gap and radially offset from lower undulation 608 across medial plane 1702 where the undulation contours meet. In an embodiment, the distance along a surface contour between inner edge 202 and outer edge 204 (a radial chord length) at all peripheral locations along the surface contour of repeating surround segment 1502 may be equal. For example, the lengths of the surface contours shown in FIGS. 17A-17C may be the same.

Figure 17C:
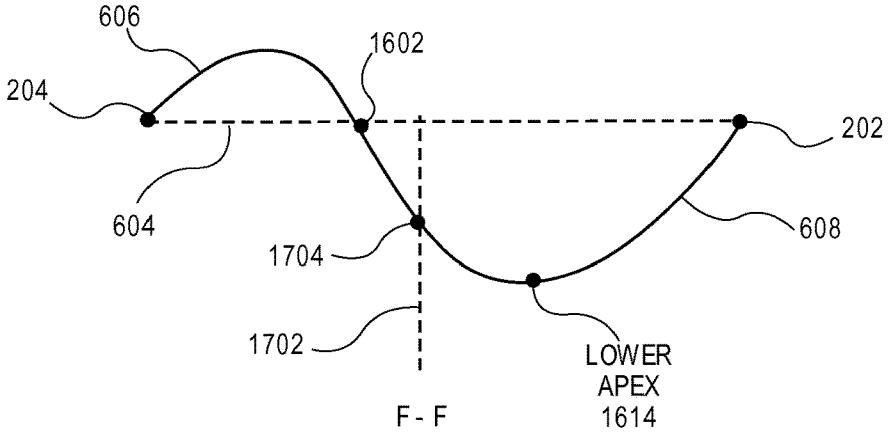

Referring to FIG. 17C, a cross-sectional view, taken about line F-F of FIG. 16, of a repeating surround segment having an upper undulation and a lower undulation is shown in accordance with an embodiment. The cross-sectional view may essentially mirror the contour of FIG. 17A across medial plane 1702 and radial plane 602, i.e., it may be the contour of FIG. 17A rotated 180 degrees. As such, lower apex 1614 is located at a maximum apical distance from radial gap 604 on an inner edge 202 side of medial plane 1702. Medial line 1704 may define a surface contour of repeating surround segment 1502 that extends in a peripheral direction from a point where repeating surround segment 1502 (and in this case lower undulation 608 of repeating surround segment) intersects medial plane 1702.

In an embodiment, intermediate line 1602 defines a surface contour of repeating surround segment 1502 at a location where upper undulation 606 and lower undulation 608 meet at radial plane 602. A radial cross-section taken through surround 110 through lower apex 1614 may coincide with a portion of surround 110 where the radial width of lower undulation 608 is greater than the radial width of upper undulation 606, and thus, intermediate line 1602 may be located between medial plane 1702 and outer edge 204. Furthermore, when viewed from above, intermediate line 1602 at the radial cross-section through lower apex 1614 may be at a point of inflection, meaning that the radial direction of a follower moving along intermediate line 1602 may change from moving toward outer edge 204 to moving toward inner edge 202. In any case, repeating surround segment 1502 includes both an upper undulation 606 above radial gap 604 and a lower undulation 608 below radial gap 604, and the upper and lower undulations may be radially arranged on opposite sides of intermediate line 1602.

In an embodiment, the distance in the radial direction along the contour of repeating surround segment 1502 may vary based on a peripheral location along surround 110. That is, rather than each radial cross-section having the same spline length along the contour surface (length along a radial chord), the spline lengths may vary from slice to slice. As a result, in an embodiment, upper undulation 606 and lower undulation 608 may always meet at medial line 1704, even though the apical distances of the undulations may vary in the peripheral direction. Thus, every radial slice of surround 110 may resemble FIG. 17B, with the height of upper undulation 606 and lower undulation 608 varying from slice to slice.

In an embodiment, every radial chord of repeating surround segment 1502, including radial chords of radial cross-sections that correspond to the pair of radial line segments 702 bounding the peripheral ends of repeating surround segment 1502, may include curvilinear line segments. For example, radial chords, e.g., radial line segment 702 that provides a transition between adjacent repeating surround segments 1502, may be sinusoidal line segments to provide for both upper undulation 606 above radial gap 604 and lower undulation 608 below radial gap 604. This contrasts with some of the above-described embodiments that include straight radial line segment 702 across radial gap 604 in that the curvilinear radial line segments 702 are not aligned or coplanar with radial plane 602.

Repeating surround segment 1502 may be repeated along a portion or all of surround 110, e.g., along surround length 1504 as shown in FIG. 15. Thus, repeating surround segment 1502 may be located adjacent to another repeating surround segment 1502 with the same characteristics of repeating surround segment 1502. For example, the adjacent repeating surround segment 1502 may have a second boundary around a second upper undulation and a second lower undulation. The second upper undulation may include a second upper peripheral chord, which may actually be an extension of upper peripheral chord 1604 as it traverses the surface of surround 110 in the peripheral direction. Similarly, the second lower undulation may include a second lower peripheral chord, which may actually be an extension of lower peripheral chord 1610 as it traverses the surface of surround 110 in the peripheral direction. Accordingly, upper peripheral chord 1604 may be contiguous with the second upper peripheral chord and lower peripheral chord 1610 may be contiguous with the second lower peripheral chord such that the repeating surround segments 1502 are arranged sequentially with each other in the peripheral direction.

Based on the above description, a person of ordinary skill in the art will appreciate that surround 110 may include a series of sequential upper undulations 608 on one side of a dividing line, e.g., intermediate line 1602, and a series of sequential lower undulations 606 on another side of the dividing line. The isolation of surround 110 surface contours to one side or the other of radial gap 604 on respective sides of a dividing line, however, is not intended to be limiting. For example, in an embodiment, surround 110 surface on an inner side of a dividing line may have lower undulations 606 and upper undulations 608 in sequence (pairs of lower undulations 606 separated by an upper undulation 608 and pairs of upper undulations 608 separated by a lower undulation). Similarly, surround 110 surface on an outer side of a dividing line may also have lower undulations 606 and upper undulations 608 in sequence. The undulations on opposite sides of the dividing line may be staggered. That is, a lower undulation 606 on an inner side of the dividing line may be radially beside an upper undulation 608 on the other side of the dividing line, and an upper undulation on the inner side of the dividing line may be radially beside a lower undulation 606 on the other side of the dividing line. Thus, a portion of surround 110 inward of the dividing line may include a surface that is both above and below radial gap 604, and a portion of the surround 110 outward of the dividing line may also include a surface that is both above and below radial gap 604.

It will be appreciated then that in an embodiment where surround segments 508 are repeating surround segments 1502 with identical surface morphologies, the pairs of radial line segments 702 that define the ends of repeating surround segment 1502 may correspond to any radial slices that are separated from each other in the peripheral direction along surround 110 and share a common surface contour. For example, radial lines segments 702 defining the surface boundary of a repeating surround segment 1502 may include radial slices through portions of surround 110 have matching profiles of cross-sections D-D, E-E, or F-F of FIGS. 17A-17C, by way of example. Accordingly, respective boundaries of sequentially arranged repeating surround segments 1502 may include a shared radial line segment 702 such that the repeating surround segments 1502 are contiguous in the peripheral direction. Additionally, the contiguous surface contours of the adjacent repeating surround segments 1502 may be continuous and smooth without angles, corners, or folds at the radial line segments 702 at which they intersect. For example, adjacent repeating surround segments 1502 may meet at a radial line segment 702 corresponding to the sinusoidal line segment of cross-section E-E of FIG. 17B. Thus, radial line segment 702 shared by the immediately adjacent repeating surround segments 1502 may intersect intermediate line 1602 at an inflection point of the radial line segment 702. The inflection point of radial line segment 702 may be the location where the surface curvature changes from concave upward along lower undulation 608 to concave downward along upper undulation 606, i.e., at the transition between undulations. In an embodiment, the inflection point of radial line segment 702 coincides with the intersection between radial line segment 702 and medial plane 1702, as shown in FIG. 17B.

The description of FIGS. 15-17C are provided above by way of example and not limitation, and it will be appreciated by one skilled in the art that the embodiments of those figures may also be combined with the embodiments described earlier. For example, peripheral chords and/or radial chords of repeating surround segment 1502 may have stepped contour profiles along respective lower undulations 606 and upper undulations 608, similar to those described with respect to FIG. 8B. Furthermore, repeating surround segments 1502 having several undulations may be separated in the peripheral direction by intermediate sections or corner sections as described with respect to FIGS. 12-14B. Additionally, surround 110 having repeating surround segments 1502 may not be shaped as a rectangular ring, as shown in FIG. 15, but may instead be annular such that perimeters of inner edge 202 and outer edge 204 are circular with respective radii. Thus, one skilled in the art will understand that the above description provides a comprehensive framework that may be used to extrapolate to other embodiments not directly described, but which are nonetheless contemplated within the scope of the description.

Referring back to FIG. 4, driven mass 402 of audio speaker 100 may oscillate along central axis 404 in the pistonic motion mode, and may also participate in non-pistonic modes. The pistonic mode may dominate the non-pistonic modes over most frequencies within the range of driving frequencies generated by an audio player during sound reproduction. Non-pistonic modes, however, may dominate the pistonic mode at some resonant frequencies, e.g., at higher order eigenfrequencies. Surround segments 508, e.g., repeating surround segments 1502, of surround 110 may be flexible in the axial direction to allow driven mass 402 to participate, i.e., move, freely in the pistonic mode within all frequencies. Surround segments 508, however, may be stiff in out-of-plane directions, e.g., in non-pistonic directions, to limit participation in non-pistonic modes. For example, the curvature of undulation surface contours may resist lateral loads and/or bending moments applied by tilting motion 410 of driven mass 402. In particular, the arrangements of upper undulations 606 and lower undulations 608 described above may create a surround 110 structure with adjacent elements that correspondingly expand/contract or stretch/compress to resist transverse loading, but which flex together under axial loading. Finite element analysis has indicated that this complementary structure may result in pistonic participation at higher order eigenfrequencies that is not less than within one order of magnitude of non-pistonic participation. This represents a decrease in non-pistonic participation at those frequencies by a factor of 55, as compared to an analysis of surround 110 having half-arc profile 206 around the entire perimeter of diaphragm 108. It follows that audio speaker 100 having surround 110 with film 506 that includes surround segments having upper undulations 606 and lower undulations 608 can reduce the tendency of surround 110 to dissipate energy in out-of-plane rocking modes and thereby diminish the likelihood of rubbing between voicecoil 106 and magnet 104 that can cause reliability and audio quality issues.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A speaker surround, comprising:

a ring-shaped film having an inner edge radially separated from an outer edge, wherein a radial plane extends through the inner edge and the outer edge, the film including a film surface undulating in a peripheral direction around the inner edge, wherein the film surface includes a plurality of upper undulations above the radial plane and a plurality of lower undulations below the radial plane, wherein the undulations include respective surface boundaries defined by the inner edge, the outer edge, and respective pairs of radial chords extending along the radial plane from the inner edge to the outer edge, and wherein the undulations include respective smooth surface curvatures extending across the respective surface boundaries.

2. The speaker surround of claim 1, wherein the plurality of upper undulations comprise an upper undulation having an upper surface curvature defined by an upper peripheral chord intersecting an upper radial chord at an upper apex above the radial plane, and wherein the plurality of lower undulations comprise a lower undulation having a lower surface curvature defined by a lower peripheral chord intersecting a lower radial chord at a lower apex below the radial plane.

3. The speaker surround of claim 2, wherein the upper peripheral chord is contiguous with the lower peripheral chord such that the upper undulation and the lower undulation are arranged sequentially in the peripheral direction.

4. The speaker surround of claim 3, wherein the respective surface boundaries of the sequentially arranged upper and lower undulations are defined by a shared radial chord such that the sequentially arranged undulations are contiguous in the peripheral direction.

5. The speaker surround of claim 4, wherein the shared radial chord is a straight line segment extending along the radial plane.

6. The speaker surround of claim 4, wherein the shared radial chord is a curvilinear line segment extending along the radial plane.

7. A speaker surround, comprising:

a ring-shaped film having an inner edge radially separated from an outer edge, wherein a radial plane extends through the inner edge and the outer edge, an intermediate line extending in a peripheral direction along the radial plane between the inner edge and the outer edge, the film undulating in the peripheral direction around the inner edge, wherein the film includes a repeating surround segment having a surface boundary defined by the inner edge, the outer edge, and a pair of radial chords extending along the radial plane from the inner edge to the outer edge and intersecting the intermediate line, and wherein the repeating surround segment includes an upper undulation above the radial plane and a lower undulation below the radial plane, the upper undulation and the lower undulation having respective smooth surface curvatures extending across the surface boundary.

8. The speaker surround of claim 7, wherein the repeating surround segment includes the upper undulation and the lower undulation, and wherein the upper undulation and the lower undulation are radially separated by the intermediate line.

9. The speaker surround of claim 8, wherein the upper undulation includes an upper surface curvature defined by an upper peripheral chord intersecting an upper radial chord at an upper apex above the radial plane, and wherein the lower undulation includes a lower surface curvature defined by a lower peripheral chord intersecting a lower radial chord at a lower apex below the radial plane.

10. The speaker surround of claim 9, wherein the upper peripheral chord of the upper undulation and the lower peripheral chord of the lower undulation are on opposite sides of the intermediate line such that the upper apex of the upper undulation and lower apex of the lower undulation are not aligned along a same peripheral chord.

11. The speaker surround of claim 10, wherein the upper surface curvature and the lower surface curvature intersect along the intermediate line such that the upper undulation and the lower undulation provide a contiguous smooth surface curvature extending across the surface boundary of the repeating surround segment.

12. The speaker surround of claim 11, further comprising a second repeating surround segment having a second surface boundary around a second upper undulation and a second lower undulation, the second upper undulation having a second upper peripheral chord contiguous with the upper peripheral chord of the upper undulation and the second lower undulation having a second lower peripheral chord contiguous with the lower peripheral chord of the lower undulation such that the repeating surround segment is arranged sequentially with the second repeating surround segment in the peripheral direction.

13. The speaker surround of claim 12, wherein the respective surface boundaries of the sequentially arranged repeating surround segment and second repeating surround segment are defined by a shared radial chord such that the repeating surround segments are contiguous in the peripheral direction.

14. The speaker surround of claim 13, wherein the shared radial chord is a curvilinear line segment extending from the inner edge to the outer edge.

15. The speaker surround of claim 14, wherein the shared radial chord intersects the intermediate line at an inflection point of the shared radial chord.

16. The speaker surround of claim 15, wherein the shared radial chord is a sinusoidal line segment extending from the inner edge to the outer edge and having the inflection point at a median point along the radial plane.

17. An audio speaker, comprising:

a frame having an inner rim;

a diaphragm along a central axis, the diaphragm having an outer rim separated from the inner rim by a radial gap around the outer rim; and a surround having a ring-shaped film undulating in a peripheral direction around the outer rim, the film including a plurality of surround segments, each surround segment having a respective surface boundary defined by an inner edge attached to the outer rim, an outer edge attached to the inner rim, and a respective pair of radial chords extending along a radial plane from the inner edge to the outer edge, wherein the plurality of surround segments include one or more upper undulations above the radial gap and one or more lower undulations below the radial gap, the undulations having respective smooth surface curvatures extending across the respective surface boundary.

18. The audio speaker of claim 17, wherein the audio speaker is a single suspension audio speaker having the surround and no spider, wherein the outer rim of the diaphragm has one or more sides, and wherein the undulations of the surround extend continuously along all of the one or more sides.

19. The audio speaker of claim 18 further comprising a driving element coupled with the diaphragm to drive the diaphragm at a plurality of resonant frequencies such that the diaphragm and the driving element move within an axial degree of freedom and one or more non-axial degrees of freedom at each resonant frequency, wherein the undulating film of the surround maintains participation in the axial degree of freedom to not less than within one order of magnitude of participation in each non-axial degree of freedom at each resonant frequency.

20. The audio speaker of claim 19, wherein the outer rim includes a plurality of corner regions, wherein the undulations of the surround extend continuously between the plurality of corner regions, and wherein the undulating film does not include an upper undulation or a lower undulation along the plurality of corner regions.

21. A speaker surround, comprising:

a ring-shaped film having an inner edge radially separated from an outer edge, wherein a radial plane extends through the inner edge and the outer edge, wherein the ring-shaped film includes a film surface undulating in a peripheral direction around the inner edge, wherein the film surface includes a plurality of upper undulations and a plurality of lower undulations, each upper undulation including an upper apex above the radial plane when the speaker surround is in a neutral position, each lower undulation including a lower apex below the radial plane when the speaker surround is in the neutral position, and wherein the plurality of upper undulations and the plurality of lower undulations include respective surface boundaries defined by the inner edge, the outer edge, and respective pairs of radial chords extending along the radial plane from the inner edge to the outer edge.

* * * * *